US007396423B2

(12) United States Patent
Jeong et al.

(10) Patent No.: US 7,396,423 B2
(45) **Date of Patent: *Jul. 8, 2008**

(54) METHOD FOR MANUFACTURING STEEL PLATE HAVING SUPERIOR TOUGHNESS IN WELD HEAT-AFFECTED ZONE

(75) Inventors: Hong-Chul Jeong, Pohang-si (KR); Hae-Chang Choi, Pohang-si (KR)

(73) Assignee: POSCO (KR)

( * ) Notice: Subject to any disclaimer, the term of this patent is extended or adjusted under 35 U.S.C. 154(b) by 448 days.

This patent is subject to a terminal disclaimer.

(21) Appl. No.: 11/105,795

(22) Filed: Apr. 14, 2005

(65) Prior Publication Data

US 2005/0173030 A1 Aug. 11, 2005

Related U.S. Application Data

(62) Division of application No. 10/476,442, filed as application No. PCT/KR01/01957 on Nov. 16, 2001, now Pat. No. 7,105,066.

(51) Int. Cl.
*C21D 8/02* (2006.01)

(52) U.S. Cl. ..... 148/654; 148/233; 148/541; 148/547

(58) Field of Classification Search ..... 148/546, 148/547, 633, 635, 648, 654, 328, 330–336, 148/230–236, 541, 661, 318, 647; 420/110, 420/129, 121, 122, 126, 128
See application file for complete search history.

(56) References Cited

U.S. PATENT DOCUMENTS

| | | | | |
|---|---|---|---|---|
| 3,904,447 | A | 9/1975 | Gondo et al. | |
| 6,686,061 | B2 * | 2/2004 | Jeong et al. | 428/684 |
| 6,946,038 | B2 * | 9/2005 | Jeong et al. | 148/330 |
| 6,966,955 | B2 * | 11/2005 | Choi et al. | 148/328 |

FOREIGN PATENT DOCUMENTS

| | | | |
|---|---|---|---|
| EP | 0 940 477 | A1 | 9/1999 |
| EP | 1 006 209 | A1 | 6/2000 |
| JP | 58-031065 | A | 2/1983 |
| JP | 60-245768 | A | 12/1985 |
| JP | 61-079745 | A | 4/1986 |
| JP | 61-190016 | A | 8/1986 |
| JP | 64-015320 | A | 1/1989 |
| JP | 5-186848 | A | 7/1993 |
| JP | 8-60292 | A | 3/1996 |
| JP | 08-232043 | A | 9/1996 |
| JP | 08-283905 | A | 12/1996 |
| JP | 9-194990 | A | 7/1997 |
| JP | 9-324238 | A | 12/1997 |
| JP | 10-298706 | A | 11/1998 |
| JP | 10-298708 | A | 11/1998 |
| JP | 11-092860 | A | 4/1999 |
| JP | 11-140582 | A | 5/1999 |
| JP | 2000-226633 | A | 8/2000 |
| JP | 2001-098340 | A | 10/2001 |
| KR | 1996-31635 | A | 9/1996 |

OTHER PUBLICATIONS

Nakanishi, Mutsuo et al., "Improvement of Welded HAZ Toughness by Dispersion with Nitride Particles and Oxide Particles", *Journal of Japanese Welding Society,* vol. 52, No. 2, pp. 49-56 (1983).
Maóai et al., "Influence of Welding Thermal Cycle on Second Phase Particle in TiMicroalloyed Steel", PCTA, vol. 36, No. 6, Jun. 2000 (4 pp.), China.
Database WPI, Section Ch, Week 200329, Derwent Publications Ltd., London, Gb; Class M, p. 24, AN 2003-296924, XP002297661 & KR 2002 091 329 A (POSCO), Dec. 6, 2002, Abstract.

* cited by examiner

*Primary Examiner*—Deborah Yee
(74) *Attorney, Agent, or Firm*—The Webb Law Firm, P.C.

(57) ABSTRACT

A welding structural steel product exhibiting a superior heat affected zone toughness, comprising, in terms of percent by weight, 0.03 to 0.17% C, 0.01 to 0.5% Si, 0.4 to 2.0% Mn, 0.005 to 0.2% Ti, 0.0005 to 0.1% Al, 0.008 to 0.030% N, 0.0003 to 0.01% B, 0.001 to 0.2% W, at most 0.03% P, at most 0.03% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, and $6.5 \leqq (Ti+2Al+4B)/N \leqq 14$, and having a microstructure essentially consisting of a complex structure of ferrite and pearlite having a grain size of 20 μm or less. The method includes the steps of preparing a slab of the above-described composition, heating the slab to 1,100° C. to 1,250° C. for 60-180 minutes, hot rolling the heated slab in an austenite recrystallization range at a 40% or more rolling reduction followed by controlled cooling.

13 Claims, No Drawings

METHOD FOR MANUFACTURING STEEL PLATE HAVING SUPERIOR TOUGHNESS IN WELD HEAT-AFFECTED ZONE

CROSS REFERENCE TO RELATED APPLICATIONS

This application is a division of U.S. patent application Ser. No. 10/476,442 filed Oct. 30, 2003, now U.S. Pat. No. 7,105,066, entitled "Steel Plate Having Superior Toughness in Weld Heat-Affected Zone, and Welded Structure Made Therefrom", which is the national phase of PCT/KR01/01957 filed Nov. 16, 2001 and incorporated herein by reference in its entirety.

BACKGROUND OF THE INVENTION

1. Field of the Invention

The present invention relates to a structural steel product suitable for use in large constructions, such as bridges, ship constructions, marine structures, steel pipes, line pipes and the like. More particularly, the present invention relates to a welding structural steel product which has a fine matrix structure, and in which precipitates of TiN exhibiting a high-temperature stability are uniformly dispersed, so that it exhibits a superior toughness in a weld heat-affected zone while exhibiting a minimum toughness difference between the heat-affected zone and the matrix. The present invention also relates to a method for manufacturing the welding structural steel product, and a welded construction using the welding structural steel product.

2. Description of the Prior Art

Recently, as the height or size of buildings and other structures has increased, steel products having an increased size have been increasingly used. That is, thick steel products have been increasingly used. In order to weld such thick steel products, it is necessary to use a welding process with a high efficiency. For welding techniques for thick steel products, a heat-input submerged welding process enabling a single pass welding, and an electro-welding process have been widely used. The heat-input welding process enabling a single pass welding is also applied to ship constructions and bridges requiring welding of steel plates having a thickness of 25 mm or more.

Generally, it is possible to reduce the number of welding passes at a higher amount of heat input because the amount of welded metal is increased. Accordingly, there may be an advantage in terms of welding efficiency where the heat-input welding process is applicable. That is, in the case of a welding process using an increased heat input, its application can be widened. Typically, the heat input used in the welding process is in the range of 100 to 200 kJ/cm. In order to weld steel plates further thickened to a thickness of 50 mm or more, it is necessary to use super-high heat inputs ranging from 200 kJ/cm to 500kJ/cm.

Where high heat input is applied to a steel product, the heat affected zone, in particular, that portion located near the weld fusion boundary, is heated to a temperature approximate to a melting point of the steel product by the welding heat input. As a result, grain growth occurs at the heat affected zone, so that a coarsened grain structure is formed. Furthermore, when the steel product is subjected to a cooling process, fine structures having degraded toughness, such as bainite and martensite, may be formed. Thus, the heat affected zone may be a site exhibiting degraded toughness.

In order to secure a desired stability of such a welding structure, it is necessary to suppress the growth of austenite grains at the heat affected zone, so as to allow the welding structure to maintain a fine structure. Known as means for meeting this requirement are techniques in which oxides stable at a high temperature or Ti-based carbon nitrides are appropriately dispersed in steels in order to delay growth of grains at the heat affected zone during a welding process. Such techniques are disclosed in Japanese Patent Laid-open Publication No. Hei. 12-226633, Hei. 11-140582, Hei. 10-298708, Hei. 10-298706, Hei. 9-194990, Hei. 9-324238, Hei. 8-60292, Sho. 60-245768, Hei. 5-186848, Sho. 58-31065, Sho. 61-79745, and Sho. 64-15320, and Journal of Japanese Welding Society, Vol. 52, No. 2, pp 49.

The technique disclosed in Japanese Patent Laid-open Publication No. Hei. 11-140582 is a representative one of techniques using precipitates of TiN. This technique has proposed structural steels exhibiting an impact toughness of about 200 J at 0° C. (in the case of a matrix, about 300 J) when a heat input of 100 J/cm (maximum heating temperature of 1,400° C.) is applied. In accordance with this technique, the ratio of Ti/N is controlled to be 4 to 12, so as to form TiN precipitates having a grain size of 0.05 μm or less at a density of $5.8\times10^3/mm^2$ to $8.1\times10^4/mm^2$ while forming TiN precipitates having a grain size of 0.03 to 0.2 μm at a density of $3.9\times10^3/mm^2$ to $6.2\times10^4/mm^2$, thereby securing a desired toughness at the welding site. In accordance with this technique, however, both the matrix and the heat affected zone exhibit substantially low toughness where a high heat-input welding process is applied. For example, the-matrix and heat affected zone exhibit impact toughness of 320 J and 220 J at 0° C., respectively. Furthermore, since there is a considerable toughness difference between the matrix and the heat affected zone, as much as about 100 J, it is difficult to secure a desired reliability for a steel construction obtained by subjecting thickened steel products to a welding process using super-high heat input Moreover, in order to obtain desired TiN precipitates, the technique involves a process of heating a slab at a temperature of 1,050° C. or more, quenching the heated slab, and again heating the quenched slab for a subsequent hot rolling process. Due to such a double heat treatment, an increase in the manufacturing costs occurs.

Generally, Ti-based precipitates serve to suppress growth of austenite grains in a temperature range of 1,200 to 1,300° C. However, where such Ti-based precipitates are maintained for a prolonged period of time at a temperature of 1,400° C. or more, a considerable amount of TiN precipitates may be dissolved again. Accordingly, it is important to prevent a dissolution of TiN precipitates so as to secure a desired toughness at the heat affected zone. However, there has been no disclosure associated with techniques capable of achieving a remarkable improvement in the toughness at the heat affected zone even in a super-high heat input welding process in which Ti-based precipitates are maintained at a high temperature of 1,350° C. for a prolonged period of time. In particular, there have been few techniques in which the heat affected zone exhibits toughness equivalent to that of the matrix. If the above mentioned problem is solved, it would then be possible to achieve a super-high heat input welding process for thickened steel products. In this case, therefore, it would then be possible to achieve a high welding efficiency while enabling an increase in the height of steel constructions, and secure a desired reliability of those steel constructions.

SUMMARY OF THE INVENTION

Therefore, it is an object of the invention to provide a welding structural steel product in which fine complex precipitates of TiN exhibiting a high-temperature stability within a welding heat input range from an intermediate heat input to a super-high heat input are uniformly dispersed, so that it exhibits a superior toughness in a heat-affected zone while exhibiting a minimum toughness difference between the matrix and the heat affected zone, to provide a method for manufacturing the welding structural steel product, and to provide a welded structure using the welding structural steel product.

In accordance with one aspect, the present invention provides a welding structural steel product exhibiting a superior heat-affected zone toughness, comprising, in terms of percent by weight, 0.03 to 0.17% C, 0.01 to 0.5% Si, 0.4 to 2.0% Mn, 0.005 to 0.2% Ti, 0.0005 to 0.1% Al, 0.008 to 0.030% N, 0.0003 to 0.01% B, 0.001 to 0.2% W, at most 0.03% P, at most 0.03% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, and $6.5 \leqq (Ti+2Al+4B)/N \leqq 14$, and having a microstructure essentially consisting of a complex structure of ferrite and pearlite having a grain size of 20 μm or less.

In accordance with another aspect, the present invention provides a method for manufacturing a welding structural steel product, comprising the steps of:

preparing a steel slab containing, in terms of percent by weight, 0.03 to 0.17% C, 0.01 to 0.5% Si, 0.4 to 2.0% Mn, 0.005 to 0.2% Ti, 0.0005 to 0.1% Al, 0.008 to 0.030% N, 0.0003 to 0.01% B, 0.001 to 0.2% W, at most 0.03% P, at most 0.03% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, and $6.5 \leqq (Ti+2Al+4B)/N \leqq 14$;

heating the steel slab at a temperature ranging from 1,100° C. to 1,250° C. for 60 to 180 minutes;

hot rolling the heated steel slab in an austenite recrystallization range at a rolling reduction rate of 40% or more; and cooling the hot-rolled steel slab at a rate of 1° C./min or more to a temperature corresponding to ±10° C. from a ferrite transformation finish temperate.

In accordance with another aspect, the present invention provides a method for manufacturing a welding structural steel product, comprising the steps of:

preparing a steel slab containing, in terms of percent by weight, 0.03 to 0.17% C, 0.01 to 0.5% Si, 0.4 to 2.0% Mn, 0.005 to 0.2% Ti 0.0005 to 0.1% Al, at most 0.005% N, 0.0003 to 0.01% B, 0.001 to 0.2% W, at most 0.03% P, at most 0.03% S, at most 0.005% O, and balance Fe and incidental impurities;

heating the steel slab at a temperature ranging from 1,100° C. to 1,250° C. for 60 to 180 minutes while nitrogenizing the steel slab to control the N content of the steel slab to be 0.008 to 0.03%, and to satisfy conditions of $1.2 \leqq Ti/N \leqq 2.5$, $10 \leqq N/B < 40$, $2.5 \leqq Al/N \leqq 7$, and $6.5 \leqq (Ti+2Al+4B)/N \leqq 14$;

hot rolling the nitrogenized steel slab in an austenite recrystallization range at a rolling reduction rate of 40% or more; and cooling the hot-rolled steel slab at a rate of 1° C./min or more to a temperature corresponding to ±10° C. from a ferrite transformation finish temperature.

In accordance with another aspect, the present invention provides a welded structure having a superior heat affected zone toughness, manufactured using a welding structural steel product according to the present invention.

DETAILED DESCRIPTION OF THE INVENTION

Now, the present invention will be described in detail.

In the specification, the term "prior austenite" represents an austenite formed at the heat affected zone in a steel product when a welding process using high heat input is applied to the steel product. This austenite is distinguished from the austenite formed in the manufacturing procedure (hot rolling process).

After carefully observing the growth behavior of the prior austenite in the heat affected zone in a steel product (matrix) and the phase transformation of the prior austenite exhibited during a cooling procedure when a welding process using high heat input is applied to the steel product, the inventors found that the heat affected zone exhibits a variation in toughness with reference to the critical grain size of the prior austenite, that is, about 80 μm, and that the toughness at the heat affected zone is increased at an increased fraction of fine ferrite.

On the basis of such an observation, the present invention is chard by:

[1] uniformly dispersing TiN precipitates in the steel product (matrix) while reducing the solubility product representing the high-temperature stability of the TiN precipitates;

[2] reducing the grain size of ferrite in the steel product (matrix) to a critical level or less so as to control the prior austenite of the heat affected zone to have a grain size of about 80 μm or less; and

[3] reducing the ratio of Ti/N in the steel product (matrix) to effectively form BN and AlN precipitates, thereby increasing the fraction of ferrite at the heat affected zone, while controlling the ferrite to have an acicular or polygonal structure effective to achieve an improvement in toughness.

The above features [1], [2], [3] of the present invention will be described in detail.

[1] TiN Precipitates

Where a high heat-input welding is applied to a structural steel product the heat affected zone near a fusion boundary is heated to a high temperature of about 1,400° C. or more. As a result, TiN precipitated in the matrix is partially dissolved due to the weld heat. Otherwise, an Ostwald ripening phenomenon occurs. That is, precipitates having a small grain size are dissolved, so that they are diffused in the form of precipitates having a larger grain size. In accordance with the Ostwald ripening phenomenon, a part of the precipitates is coarsened. Furthermore, the density of TiN precipitates is considerably reduced, so that the effect of suppressing growth of prior austenite grains disappears.

After observing a variation in the characteristics of TiN precipitates depending on the ratio of Ti/N while taking into consideration the fact that the above phenomenon may be caused by diffusion of Ti atoms occurring when TiN precipitates dispersed in the matrix are dissolved by the welding heat, the inventors discovered the new fact that under a high nitrogen concentration condition (that is, a low Ti/N ratio), the concentration and diffusion rate of dissolved Ti atoms are reduced, thereby obtaining an improved high-temperature stability of TiN precipitates. That is, when the ratio between Ti and N (Ti/N) ranges from 1.2 to 2.5, the amount of dissolved Ti is greatly reduced, thereby causing TiN precipitates to have an increased high-temperature stability. In this case, fine TiN precipitates having a grain size of 0.01 to 0.1 μm are dispersed at a density of $1.0 \times 10^7/mm^2$ or more while having a uniform space of about 0.5 μm or less. Such a surprising result was assumed to be based on the fact that the solubility product representing the high-temperature stability of TiN precipitates is reduced at a reduced content of nitrogen, because when the content of nitrogen is increased under the condition in which the content of Ti is constant, all dissolved Ti atoms are easily coupled with nitrogen atoms, and the amount of dissolved Ti is reduced under a high nitrogen concentration condition.

The inventors also discovered an interesting fact. That is, even when a high-nitrogen steel is manufactured by producing, from a steel slab, a low-nitrogen steel having a nitrogen content of 0.005% or less to exhibit a low possibility of generation of slab surface cracks, and then subjecting the low-nitrogen steel to a nitrogenizing treatment in a slab heating furnace, it is possible to obtain desired TiN precipitates as defined above, in so far as the ratio of Ti/N is controlled to be 1.2 to 2.5. This was analyzed to be based on the fact that when an increase in nitrogen content is made in accordance with a nitrogenizing treatment under the condition in which the content of Ti is constant, all dissolved Ti atoms are easily rendered to be coupled with nitrogen atoms, thereby reducing the solubility product of TiN representing the high-temperature stability of TiN precipitates.

In accordance with the present invention, in addition to the control of the ratio of Ti/N, respective ratios of N/B, Al/N, and V/N, the content of N, and the total content of Ti+Al+B+(V) are generally controlled to precipitate N in the form of BN, AlN, and VN, taking into consideration the fact that promoted aging may occur due to the presence of dissolved N under a high-nitrogen environment In accordance with the present invention, as described above, the toughness difference between the matrix and the heat affected zone is reduced to 30 J or less by controlling the density of TiN precipitates and solubility product of TiN depending on the ratio of Ti/N. This scheme is considerably different from the conventional precipitate control scheme (Japanese Patent Laid-open Publication No. Hei. 11-140582) in which the amount of TiN precipitates is increased by simply increasing the content of Ti ($Ti/N \geqq 4$).

[2] Microstructure of Steels (Matrix)

After research, the inventors found that in order to control the prior austenite in the heat-affected zone to have a grain size of about 80 μm or less, it is important to form fine ferrite grains in a complex matrix structure of ferrite and pearlite, in addition to control of precipitates. The refinement of ferrite grains can be achieved by fining austenite grains in accordance with a hot rolling process or suppressing growth of ferrite grains occurring during a cooling process by use of carbides (WC and VC).

[3] Microstructure of Heat Affected Zone

After research, the inventors also found that the toughness of the heat affected zone is considerably influenced by not only the size of prior austenite grains formed when the matrix is heated to a temperature of 1,400° C., but also the amount and shape of ferrite precipitated at the grain boundary of the prior austenite during a cooling process. In other words, it is important to reduce the size of prior austenite grains while increasing the amount of ferrite, taking into consideration the toughness of the heat affected zone. In particular, it is preferable to generate a transformation of polygonal ferrite or acicular ferrite in austenite grains. For this transformation, AlN, $Fe_{23}(B,C)_6$, and BN precipitates are utilized in accordance with the present invention.

The present invention will now be described in conjunction with respective components of a steel product to be manufactured, and a manufacturing method for the steel product.

Welding Structural Steel Product

First, the composition of the welding structural steel product according to the present invention will be described.

In accordance with the present invention, the content of carbon (C) is limited to a range of 0.03 to 0.17 weight % (hereinafter, simply referred to as "%").

Where the content of carbon (C) is less than 0.03%, it is not possible to secure a sufficient strength for structural steels. On the other hand, where the C content exceeds 0.17%, transformation of weak-toughness microstructures such as upper bainite, martensite, and degenerate pearlite occurs during a cooling process, thereby causing the structural steel product to exhibit a degraded low-temperature impact toughness. Also, an increase in the hardness or strength of the welding site occurs, thereby causing a degradation in toughness and generation of welding cracks.

The content of silicon (Si) is limited to a range of 0.01 to 0.5%.

At a silicon content of less than 0.01%, it is not possible to obtain a sufficient deoxidizing effect of molten steel in the steel manufacturing process. In this case, the steel product also exhibits a degraded corrosion resistance. On the other hand, where the silicon content exceeds 0.5%, a saturated deoxidizing effect is exhibited. Also, transformation of M-A constituent martensite is promoted due to an increase in hardenability occurring in a cooling process following a rolling process. As a result, a degradation in low-temperature impact toughness occurs.

The content of manganese (Mn) is limited to a range of 0.4 to 2.0%.

Mn has an effective element for improving the deoxidizing effect, weldability, hot workability, and strength of steels. Mn forms a substitutional solid solution in a matrix, thereby solid-solution strengthening the matrix to secure desired strength and toughness. In order to obtain such effects, it is desirable for Mn to be contained in the composition in a content of 0.4% or more. However, where the Mn content exceeds 2.0%, there is no increased solid-solution strengthening effect. Rather, segregation of Mn is generated, which causes a structural non-uniformity adversely affecting the toughness of the heat affected zone. Also, macroscopic segregation and microscopic segregation occur in accordance with a segregation mechanism in a solidification procedure of steels, thereby promoting formation of a central segregation band in the matrix in a rolling process. Such a central segregation band serves as a cause for forming a central low-temperature transformed structure in the matrix. In particular, Mn is precipitated in the form of MnS around Ti-based oxides, so that it promotes generation of acicular and polygonal ferrite effective to improve the toughness of the heat affected zone.

The content of titanium (Ti) is limited to a range of 0.005 to 0.2%.

Ti is an essential element in the present invention because it is coupled with N to form fine TiN precipitates stable at a high temperature. In order to obtain such an effect of precipitating fine TiN grains, it is desirable to add Ti in an amount of 0.005% or more. However, where the Ti content exceeds 0.2%, coarse TiN precipitates and Ti oxides may be formed in molten steel. In this case, it is not possible to suppress the growth of prior austenite grains in the heat affected zone.

The content of aluminum (Al) is limited to a range of 0.0005 to 0.1%.

Al is an element which is not only necessarily used as a deoxidizer, but also serves to form fine AlN precipitates in steels. Al also reacts with oxygen to form an Al oxide. Thus, Al aids Ti to form fine TiN precipitates without reacting with oxygen. In order to form fine TiN precipitates, Al should be added in an amount of 0.0005% or more. However, when the content of Al exceeds 0.1%, dissolved Al remaining after precipitation of AlN promotes formation of Widmanstatten ferrite and M-A constituent martensite exhibiting weak toughness in the heat affected zone in a cooling process. As a result, a degradation in the toughness of the heat affected zone occurs where a high heat input welding process is applied.

The content of nitrogen (N) is limited to a range of 0.008 to 0.03%.

N is an element essentially required to form TiN, AlN, BN, VN, NbN, etc. N serves to suppress, as much as possible, the growth of prior austenite grains in the heat affected zone when a high heat input welding process is carried out, while increasing the amount of precipitates such as TiN, AlN, BN, VN, NbN, etc. The lower limit of N content is determined to be 0.008% because N considerably affects the grain size, space, and density of TiN and AlN precipitates, the frequency of those precipitates to form complex precipitates with oxides, and the high-temperature stability of those precipitates. However, when the N content exceeds 0.03%, such effects are saturated. In this case, a degradation in toughness occurs due to an increased amount of dissolved nitrogen in the heat affected zone. Furthermore, the surplus N may be included in the welding metal in accordance with a dilution occurring in the welding process, thereby causing a degradation in the toughness of the welding metal. Accordingly, the upper limit of the N content is determined to be 0.03%.

Meanwhile, the slab used in accordance with the present invention may be low-nitrogen steels which may be subsequently subjected to a nitrogenizing treatment to form high-nitrogen steels. In this case, the slab has an N content of 0.0005% or less in order to exhibit a low possibility of generation of slab surface cracks. The slab is then subjected to a re-heating process involving a nitrogenizing treatment, so as to manufacture high-nitrogen steels having an N content of 0.008 to 0.03%.

The content of boron (B) is limited to a range of 0.0003 to 0.01%.

B forms BN precipitates, thereby suppressing the growth of prior austenite grains. Also, B forms Fe boron carbides in grain boundaries and within grains, thereby promoting transformation into acicular and polygonal ferrites exhibiting a superior toughness. It is not possible to expect such effects when the B content is less than 0.0003%. On the other hand, when the B content exceeds 0.01%, an increase in hardenability may undesirably occur, so that there may be possibilities of hardening the heat affected zone, and generating low-temperature cracks.

The content of tungsten (W) is limited to a range of 0.001 to 0.2%.

When tungsten is subjected to a hot rolling process, it is uniformly precipitated in the form of tungsten carbides (WC) in the matrix, thereby effectively suppressing growth of ferrite grains after ferrite transformation. Tungsten also serves to suppress the growth of prior austenite grains at the initial stage of a heating process for the heat affected zone. Where the tungsten content is less than 0.001%, the tungsten carbides serving to suppress the growth of ferrite grains during a cooling process following the hot rolling process are dispersed at an insufficient density. On the other hand, where the tungsten content exceeds 0.2%, the effect of tungsten is undesirably saturated.

The contents of phosphorous (P) and sulfur (S) are limited to 0.030% or less respectively.

Since P is an impurity element causing central segregation in a rolling process and formation of high-temperature cracks in a welding process, it is desirable to control the content of P to be as low as possible. In order to achieve an improvement in the toughness of the heat affected zone and a reduction in central segregation, it is desirable for the P content to be 0.03% or less.

Where S is present in an excessive amount, it may form a low-melting point compound such as FeS. Accordingly, it is desirable to control the content of S to be as low as possible. It is also preferable for the content of S to be 0.03% or less for reduction of the matrix toughness, heat-affected zone toughness, and central segregation. S is precipitated in the form of MnS around Ti-based oxides, so that it promotes formation of acicular and polygonal ferrite effective to improve the toughness of the heat affected zone. Taking into consideration the formation of high-temperature cracks in a welding process, it is preferable for the content of S to be limited within a range of 0.003% to 0.03%.

The content of oxygen (C) is limited to 0.005% or less.

Where the content of C exceeds 0.005%, Ti forms Ti oxides in molten steels, so that it cannot form TiN precipitates. Accordingly, it is undesirable for the C content to be more than 0.005%. Furthermore, inclusions such as coarse Fe oxides and Al oxides may be formed which undesirably affect the toughness of the matrix.

In accordance with the present invention, the ratio of Ti/N is limited to a range of 1.2 to 2.5.

When the ratio of Ti/N is limited to a desired range as defined above, there are two advantages as follows.

First, it is possible to increase the density of TiN precipitates while uniformly dispersing those TiN precipitates. That is, when the nitrogen content is increased under the condition in which the Ti content is constant, all dissolved Ti atoms are easily coupled with nitrogen atoms in a continuous casting process (in the case of a high-nitrogen slab) or in a cooling process following a nitrogenizing treatment (in the case of a low-nitrogen slab), so that fine TiN precipitates are formed while being dispersed at an increased density.

Second, the solubility product of TiN representing the high-temperature stability of TiN precipitates is reduced, thereby preventing a re-dissolution of Ti. That is, Ti has stronger property of coupling with N than that of being dissolved under a high-nitrogen environment Accordingly, Ti/N precipitates are stable at a high temperature.

Therefore, the ratio of Ti/N is controlled to be 1.2 to 2.5 in accordance with the present invention. When the Ti/N ratio is less than 1.2, the amount of nitrogen dissolved in the matrix is increased, thereby degrading the toughness of the heat affected zone. On the other hand, when the Ti/N ratio is more than 2.5, coarse TiN grains are formed. In this case, it is difficult to obtain a uniform dispersion of TiN. Furthermore, the surplus Ti remaining without being precipitated in the form of TiN is present in a dissolved state, so that it may adversely affect the toughness of the heat affected zone.

The ratio of N/B is limited to a range of 10 to 40.

When the ratio of N/B is less than 10, BN serving to promote a transformation into polygonal ferrites at the grain boundaries of prior austenite is precipitated in an insufficient amount in the cooling process following the welding process. On the other hand, when the N/B ratio exceeds 40, the effect of BN is saturated. In this case, an increase in the amount of dissolved nitrogen occurs, thereby degrading the toughness of the heat affected zone.

The ratio of Al/N is limited to a range of 2.5 to 7.

Where the ratio of Al/N is less than 2.5, AlN precipitates for causing a transformation into acicular ferrites are dispersed at an insufficient density. Furthermore, an increase in the amount of dissolved. nitrogen in the heat affected zone occurs, thereby possibly causing formation of welding cracks. On the other hand, where the Al/N ratio exceeds 7, the effects obtained by controlling the Al/N ratio are saturated.

The ratio of (Ti+2Al+4B)/N is limited to a range of 6.5 to 14.

Where the ratio of (Ti+2Al+4B)/N is less than 6.5, the grain size and density of TiN, AlN, BN, and VN precipitates are insufficient, so that it is not possible to achieve suppression of the growth of prior austenite grains in the heat affected zone, formation of fine polygonal ferrite at grain boundaries, control of the amount of dissolved nitrogen, formation of acicular ferrite and polygonal ferrite within grains, and control of structure fractions. On the other hand, when the ratio of (Ti+2Al+4B)/N exceeds 14, the effects obtained by controlling the ratio of (Ti+2Al+4B)/N are saturated. Where V is added, it is preferable for the ratio of (Ti+2Al+4B+V)/N to range from 7 to 17.

In accordance with the present invention, V may also be selectively added to the above defined steel composition.

V is an element which is coupled with N to form VN, thereby promoting formation of ferrite in the heat affected zone. VN is precipitated alone, or precipitated in TiN precipitates, so that it promotes a ferrite transformation. Also, V is coupled with C, thereby forming a carbide, that is, VC. This VC serves to suppress growth of ferrite grains after the ferrite transformation.

Thus, V further improves the toughness of the matrix and the toughness of the heat affected zone. In accordance with the present invention, the content of V is preferably limited to a range of 0.01 to 0.2%. Where the content of V is less than 0.01%, the amount of precipitated VN is insufficient to obtain an effect of promoting the ferrite transformation in the heat affected zone. On the other hand, where the content of V exceeds 0.2%, both the toughness of the matrix and the toughness of the heat affected zone are degraded. In this case, an increase in welding hardenability occurs. For this reason, there is a possibility of formation of undesirable low-temperature welding cracks.

Where V is added, the ratio of V/N is preferably controlled to be 0.3 to 9.

When the ratio of V/N is less than 0.3, it may be difficult to secure an appropriate density and grain size of VN precipitates dispersed at boundaries of complex precipitates of TiN and MnS for an improvement in the toughness of the heat affected zone. On the other hand, when the ratio of V/N exceeds 9, the VN precipitates dispersed at the boundaries of complex precipitates of TiN and MnS may be coarsened, thereby reducing the density of those VN precipitates. As a result, the fraction of ferrite effectively serving to improve the toughness of the heat affected zone may be reduced.

In order to further improve mechanical properties, the steels having the above defined composition may be added with one or more element selected from the group consisting of Ni, Cu, Nb, Mo, and Cr in accordance with the present invention.

The content of Ni is preferably limited to a range of 0.1 to 3.0%.

Ni is an element which is effective to improve the strength and toughness of the matrix in accordance with a solid-solution strengthening. In order to obtain such an effect, the Ni content is preferably 0.1% or more. However, when the Ni content exceeds 3.0%, an increase in hardenability occurs, thereby degrading the toughness of the heat affected zone. Furthermore, there is a possibility of formation of high-temperature cracks in both the heat affected zone and the matrix.

The content of copper (Cu) is limited to a range of 0.1 to 1.5%.

Cu is an element which is dissolved in the matrix, thereby solid-solution strengthening the matrix. That is, Cu is effective to secure desired strength and toughness for the matrix. In order to obtain such an effect, Cu should be added in a content of 0.1% or more. However, when the Cu content exceeds 1.5%, the hardenability of the heat affected zone is increased, thereby causing a degradation in toughness. Furthermore, formation of high-temperature cracks at the heat affected zone and welding metal is promoted. In particular, Cu is precipitated in the form of CuS around Ti-based oxides, along with S, thereby influencing the formation of ferrites having an acicular or polygonal structure effective to achieve an improvement in the toughness of the heat affected zone. Accordingly, it is preferred for the Cu content to be 0.3 to 1.5%.

Where Cu is used in combination with Ni the total content of Cu and Ni is preferably 3.5% or less. When the total content of Cu and Ni is more than 3.5%, an undesirable increase in hardenability occurs, thereby adversely affecting the heat-affected zone toughness and weldability.

The content of Nb is preferably limited to a range of 0.01 to 0.10%.

Nb is an element which is effective to secure a desired strength of the matrix. It is not possible to expect such an effect when Nb is added in an amount of less than 0.01%. However, when the content of Nb exceeds 0.1%, coarse NbC may be precipitated alone, adversely affecting the toughness of the matrix.

The content of molybdenum (Mo) is preferably limited to a range of 0.05 to 1.0%.

Mo is an element to increase hardenability while improving strength. In order to secure desired strength, it is necessary to add Mo in an amount of 0.05% or more. However, the upper limit of the Mo content is determined to be 1.0%, similarly to Cr, in order to suppress hardening of the heat affected zone and formation of low-temperature welding cracks.

The content of chromium (Cr) is preferably limited to a range of 0.05 to 1.0%.

Cr serves to increase hardenability while improving strength. AT a Cr content of less than 0.05%, it is not possible to obtain desired strength. On the other hand, when the Cr content exceeds 1.0%, a degradation in toughness in both the matrix and the heat affected zone occurs.

In accordance with the present invention, one or both of Ca and REM may also be added in the above defined steel composition in order to suppress the growth of prior austenite grains in a heating process.

Ca and REM serve to form an oxide exhibiting a superior high-temperature stability, thereby suppressing the growth of austenite grains in the matrix during a heating process while improving the toughness of the heat affected zone. Also, Ca has an effect of controlling the shape of coarse MnS in a steel manufacturing process. For such effects, Ca is preferably added in an amount of 0.0005% or more, whereas REM is preferably added in an amount of 0.005% or more. However, when the Ca content exceeds 0.005%, or the REM content exceeds 0.05%, large-size inclusions and clusters are formed, thereby degrading the cleanness of steels. For REM, one or more of Ce, La, Y, and Hf may be used.

Now, the microstructure of the welding structural steel product according to the present invention will be described.

Preferably, the microstructure of the welding structural steel product according to the present invention is a complex structure of ferrite and pearlite. Also, the ferrite preferably has a grain size limited to 20 μm or less. Where ferrite grains have a grain size of more than 20 μm, the prior austenite grains in the heat affected zone is rendered to have a grain size of 80 μm or more when a high heat input welding process is applied, thereby degrading the toughness of the heat affected zone.

Where the fraction of ferrite in the complex structure of ferrite and pearlite is increased, the toughness and elongation of the matrix are correspondingly increased. Accordingly, the fraction of ferrite is determined to be 20% or more, and preferably 70% or more.

Meanwhile, the grains of prior austenite in the heat affected zone are considerably affected by the size and density of nitrides dispersed in the matrix where the grains of ferrite in the steel product (matrix) have a constant size. When a high input welding is applied(heating temperature, 1400° C.), 30 to 40% of nitrides dispersed in the matrix are dissolved again in the matrix, thereby degrading the effect of suppressing the growth of prior austenite grains in the heat affected zone.

For this reason, it is necessary to disperse an excessive amount of nitrides in the matrix, taking into consideration the fraction of nitrides to be dissolved again In accordance with the present invention, fine TiN precipitates are uniformly dispersed in order to suppress the growth of prior austenite in the heat affected zone. Accordingly, it is possible to effectively suppress occurrence of an Ostwald ripening phenomenon causing coarsening of precipitates.

Preferably, TiN precipitates are uniformly dispersed in the matrix while having a spacing of about 0.5 μm or less.

More preferably, TN precipitates have a grain size of 0.01 to 0.1 μm, and a density of $1.0\times10^7/mm^2$. Where TiN precipitates have a grain size of less than 0.01 μm, they may be easily dissolved again in the matrix in a welding process using a high heat input, so that they cannot effectively suppress the growth of austenite grains. On the other hand, where TiN precipitates have a grain size of more than 0.1 μm they exhibit an insufficient pinning effect (suppression of growth of grains) on austenite grains, and behave like as coarse non-metallic inclusions, thereby adversely affecting mechanical properties. Where the density of the fine precipitates is less than $1.0\times10^7/mm^2$, it is difficult to control the critical austenite grain size of the heat affected zone to be 80 μm or less where a welding process using a high input heat is applied.

Method for Manufacturing Welding Structural Steel Products

In accordance with the present invention, a steel slab having the above defined composition is first prepared.

The steel slab of the present invention may be manufactured by conventionally processing, through a casting process, molten steel treated by conventional refining and deoxidizing processes. However, the present invention is not limited to such processes.

In accordance with the present invention, molten steel is primarily refined in a converter, and tapped into a ladle so that it may be subjected to a "refining outside furnace" process as a secondary refining process. In the case of thick products such as welding structural steel products, it is desirable to perform a degassing treatment (Ruhrstahi Hereaus (RH) process) after the "refining outside furnace" process. Typically, deoxidization is carried out between the primary and secondary refining processes.

In the deoxidizing process, it is most desirable to add Ti under the condition in which the amount of dissolved oxygen has been controlled not to be more than an appropriate level in accordance with the present invention. This is because most of Ti is dissolved in the molten steel without forming any oxide. In this case, an element having a deoxidizing effect higher than that of Ti is preferably added prior to the addition of Ti.

This will be described in more detail. The amount of dissolved oxygen greatly depends on an oxide production behavior. In the case of deoxidizing agents having a higher oxygen affinity, their rate of coupling with oxygen in molten steel is higher. Accordingly, where a deoxidation is carried out using an element having a deoxidizing effect higher than that of Ti, prior to the addition of Ti, it is possible to prevent Ti from forming an oxide, as much as possible. Of course, a deoxidation may be carried out under the condition that Mn, Si, etc. belonging to the 5 elements of steel are added prior to the addition of the element having a deoxidizing effect higher than that of Ti, for example, Al. After the deoxidation, a secondary deoxidation is carried out using Al. In this case, there is an advantage in that it is possible to reduce the amount of added deoxidizing agents. Respective deoxidizing effects of deoxidizing agents are as follows:

$$Cr<Mn<Si<Ti<Al<REM<Zr<Ca\approx Mg$$

As apparent from the above description, it is possible to control the amount of dissolved oxygen to be as low as possible by adding an element having a deoxidizing effect higher than that of Ti, prior to the addition of Ti, in accordance with the present invention. Preferably, the amount of dissolved oxygen is controlled to be 30 ppm or less. When the amount of dissolved oxygen exceeds 30 ppm, Ti may be coupled with oxygen existing in the molten steel, thereby forming a Ti oxide. As a result, the amount of dissolved Ti is reduced.

It is preferred that after the control of the dissolved oxygen amount, the addition of Ti be completed within 10 minutes under the condition that the content of Ti ranges from 0.005% to 0.2%. This is because the amount of dissolved Ti may be reduced with the lapse of time due to production of a Ti oxide after the addition of Ti.

In accordance with the present invention, the addition of Ti may be carried out at any time before or after a vacuum degassing treatment.

In accordance with the present invention, a steel slab may be manufactured using the molten steel prepared as described above. Where the prepared molten steel is low-nitrogen steel (requiring a nitrogenizing treatment), it is possible to carry out a continuous casting process irrespective of its casting speed, that is, a low casting speed or a high casting speed. However, where the molten steel is high-nitrogen steel it is desirable, in terms of an improvement in productivity, to cast the molten steel at a low casting speed while maintaining a weak cooling condition in the secondary cooling zone, taking into consideration the fact that high-nitrogen steel has a high possibility of formation of slab surface cracks.

Preferably, the casting speed of the continuous casting process is 1.1 m/min lower than a typical casting speed, that is, about 1.2 m/min. More preferably, the casting speed is controlled to be about 0.9 to 1.1 m/min. At a casting speed of less than 0.9 m/min, a degradation in productivity occurs even though there is an advantage in terms of reduction of slab surface cracks. On the other hand, where the casting speed is higher than 1.1 m/min, the possibility of formation of slab surface cracks is increased. Even in the case of low-nitrogen steel, it is possible to obtain a better internal quality when the steel is cast at a low speed of 0.9 to 1.2 m/min.

Meanwhile, it is desirable to control the cooling condition at the secondary cooling zone because the cooling condition influences the fineness and uniform dispersion of TiN precipitates.

For high-nitrogen molten steel, the water spray amount in the secondary cooling zone is determined to be 0.3 to 0.35 l/kg for weak cooling. When the water spray amount is less than 0.3 l/kg, coarsening of TiN precipitates occurs. As a result, it may be difficult to control the grain size and density of TiN precipitates in order to obtain desired effects according to the present invention. On the other hand, when the water spray amount is more than 0.35 l/kg, the frequency of formation of TiN precipitates is too low so that it is difficult to control the grain size and density of TiN precipitates in order to obtain desired effects according to the present invention.

Thereafter, the steel slab prepared as described above is heated in accordance with the present invention.

In the case of a high-nitrogen steel slab having a nitrogen content of 0.008 to 0.030%, it is heated at a temperature of 1,100 to 1,250° C. for 60 to 180 minutes. When the slab heating temperature is less than 1,100° C., the diffusion rate of solute atoms is too slow, thereby reducing the density of TiN precipitates. On the other hand, where the slab heating temperature is more than 1,250° C., TiN precipitates are coarsened or dissolved, thereby reducing the density of the precipitates. Meanwhile, where the slab heating time is less than 60 minutes, there is no effect of reducing segregation of solute atoms. Furthermore, the solute atoms are diffused, so that the given time is insufficient to allow for the solute atoms to be diffused for formation of precipitates. When the heating time exceeds 180 minutes, the grains of austenite are coarsened. In this case, a degradation in productivity may occur.

For a low-nitrogen steel slab containing nitrogen in an amount of 0.005%, a nitrogenizing treatment is carried out in a slab heating furnace in accordance with the present invention so as to obtain a high-nitrogen steel slab while adjusting the ratio between Ti and N.

In accordance with the present invention, the low-nitrogen steel slab is heated at a temperature of 1,100 to 1,250° C. for 60 to 180 minutes for a nitrogenizing treatment thereof in order to control the nitrogen concentration of the slab to be preferably 0.008 to 0.03%. In order to secure an appropriate amount of TiN precipitates in the slab, the nitrogen content should be 0.008% or more. However, when the nitrogen content exceeds 0.03%, nitrogen may be diffused in the slab, thereby causing the amount of nitrogen at the surface of the slab to be more than the amount of nitrogen precipitated in the form of fine TiN precipitates. AS a result, the slab is hardened at its surface, thereby adversely affecting the subsequent rolling process.

When the heating temperature of the slab is less than 1,100° C., nitrogen cannot be sufficiently diffused, thereby causing fine TiN precipitates to have a low density. Although it is possible to increase the density of TiN precipitates by increasing the heating time, this would increase the manufacturing costs. On the other hand, when the heating temperature is more than 1,250° C., growth of austenite grains occurs in the slab during the heating process, adversely affecting the recrystallization to be performed in the subsequent rolling process. Where the slab heating time is less than 60 minutes, it is not possible to obtain a desired nitrogenizing effect. On the other hand, where the slab heating time is more than 180 minutes, the manufacturing costs increase. Furthermore, growth of austenite grains occurs in the slab, adversely affecting the subsequent rolling process.

Preferably, the nitrogenizing treatment is performed to control, in the slab, the ratio of Ti/N to be a.2 to 2.5, the ratio of N/B to be 10 to 40, the ratio of Al/N to be 2.5 to 7, the ratio of (Ti _2Al_4B)/N to be 6.5 to 14, the ratio of V/N to be 0.3 to 9, and the ratio of (Ti+2Al+4B+V)/N to be 7 to 17.

Thereafter, the heated steel slab is hot-rolled in an austenite recrystallization temperature range (about 850 to 1,050° C.) at a rolling reduction rate of 40% or more. The austenite recrystallization temperature range depends on the composition of the steel, and a previous rolling reduction rate. In accordance with the present invention, the austenite recrystallization temperature range is determined to be about 850 to 1,050° C., taking into consideration a typical rolling reduction rate.

Where the hot rolling temperature is less than 850° C., the structure is changed into elongated austenite in the rolling process because the hot rolling temperature is within a non-crystallization temperature range. For this reason, it is difficult to secure fine ferrite in a subsequent cooling process. On the other hand, where the hot rolling temperature is more than 1,050° C., grains of recrystallized austenite formed in accordance with recrystallization are grown, so that they are coarsened. As a result, it is difficult to secure fine ferrite grains in the cooling process. Also, when the accumulated or single rolling reduction rate in the rolling process is less then 40%, there are insufficient sites for formation of ferrite nuclei within austenite grains. As a result, it is not possible to obtain an effect of sufficiently fining ferrite grains in accordance with recrystallization of austenite.

The rolled steel slab is then cooled to a temperature ranging ±10° C. from a ferrite transformation finish temperature at a rate of 1° C./min or more. Preferably, the rolled steel slab is cooled to the ferrite transformation finish temperature at a rate of 1° C./min or more, and then cooled in air.

Of course, there is no problem associated with fining of ferrite even when the rolled steel slab is cooled to normal temperature at a rate of 1° C./min. However, this is undesirable because it is uneconomical. Although the rolled steel slab is cooled to a temperature ranging ±10° C. from the ferrite transformation finish temperature at a rate of 1° C./min or more, it is possible to prevent growth of ferrite grains. When the cooling rate is less than 1° C./min, growth of recrystallized fine ferrite grains occurs. In this case, it is difficult to secure a ferrite grain size of 20 μm or less.

As apparent from the above description, it is possible to manufacture a steel product having a complex structure of ferrite and pearlite as its microstructure while exhibiting a superior heat affected zone toughness by controlling manufacturing conditions such as heating and rolling conditions while regulating the composition of the steel product, for example, the ratio of Ti/N. Also, it is possible to effectively manufacture a steel product in which fine TiN precipitates having a grain size of 0.01 to 0.1 μm are dispersed at a density of $1.0\times10^7/mm^2$ or more while having a space of 0.5 n or less.

Meanwhile, slabs can be manufactured using a continuous casting process or a mold casting process as a steel casting process. Where a high cooling rate is used, it is easy to finely disperse precipitates. Accordingly, it is desirable to use a continuous casting process. For the same reason, it is advantageous for the slab to have a small thickness. As the hot rolling process for such a slab, a hot charge rolling process or a direct rolling process may be used. Also, various techniques such as known controlled rolling processes and controlled cooling processes may be employed. In order to improve the mechanical properties of hot-rolled plates manufactured in accordance with the present invention, an additional heat treatment may be applied. It should be noted that although such known techniques are applied to the present invention, such an application is made within the scope of the present invention.

Welded Structures

The present invention also relates to a welded structure manufactured using the above described welding structural steel product. Therefore, included in the present invention are welded structures manufactured using a welding structural steel product having the above defined composition according to the present invention, a microstructure corresponding to a complex structure of ferrite and pearlite having a grain size of about 20 μm or less, or TiN precipitates having a grain size of 0.01 to 0.1 μm while being dispersed at a density of $1.0\times10^7/mm^2$ or more and with a spacing of 0.5 μm or less.

Where a high heat input welding process is applied to the above described welding structural steel product, prior austenite having a grain size of 80 μm or less is formed. Where the grain size of the prior austenite in the heat affected zone is more than 80 μm, an increase in hardenability occurs, thereby causing easy formation of a low-temperature structure (martensite or upper bainite). Furthermore, although ferrites having different nucleus forming sites are formed at grain boundaries of austenite, they are merged together when growth of grains occurs, thereby causing an adverse effect on toughness.

When the steel product is quenched after an application of a high heat input welding process thereto, the microstructure of the heat affected zone includes ferrite having a grain size of 20 μm or less at a volume fraction of 70% or more. Where the grain size of the ferrite is more than 20 μm, the fraction of side plate or allotriomorphs ferrite adversely affecting the toughness of the heat affected zone increases. In order to achieve an improvement in toughness, it is desirable to control the volume fraction of ferrite to be 70% or more. When the ferrite of the present invention has characteristics of polygonal ferrite or acicular ferrite, an improvement in toughness is expected. In accordance with the present invention, this can be induced by forming BN and Fe boron carbides at grain boundaries and within grains for improving toughness.

When a high heat input welding process is applied to the welding structural steel product (matrix), prior austenite having a grain size of 80 μm or less is formed at the heat affected zone. In accordance with a subsequent quenching process, the microstructure of the heat affected zone includes ferrite having a grain size of 20 μm or less at a volume fraction of 70% or more.

Where a welding process using a heat input of 100 kJ/cm or less is applied to the welding structural steel product of the present invention (in the case "$\Delta_{t800-500}$=120 seconds" in Table 5), the toughness difference between the matrix and the heat affected zone is within a range of ±50 J. Also, in the case of a welding process using a high heat input of 100 to 250 kJ/cm ("$\Delta_{t800-500}$=120 seconds" in Table 5), the toughness difference between the matrix and the heat affected zone is within a range of ±70 J. In the case of a welding process using a high heat input of more than 250 kJ/cm ("$\Delta_{t800-500}$=180 seconds" in Table 5), the toughness difference between the matrix and the heat affected zone is within a range of 0 to 100 J. Such results can be seen from the following examples.

EXAMPLES

Hereinafter, the present invention will be described in conjunction with various examples. These examples are made only for illustrative purposes, and the present invention is not to be construed as being limited to or by those examples.

Example 1

Each of steel products having different steel compositions of Table 1 was melted in a convert. The resultant molten steel was subjected to a casting process performed at a casting rate of 1.1 m/min, thereby manufacturing a slab. The slab was then hot rolled under the condition of Table 3, thereby manufacturing a hot-rolled plate. The hot-rolled plate was cooled until its temperature reached to 500° C. corresponding to the temperature lower than a ferrite transformation finish temperature. Following this temperature, the hot-rolled plate was cooled in air.

Table 2 describes content ratios of alloying elements in each steel product.

TABLE 1

| | C | Si | Mn | P | S | Al | Ti | B(ppm) | N(ppm) | W |
|---|---|---|---|---|---|---|---|---|---|---|
| Present Steel 1 | 0.12 | 0.13 | 1.54 | 0.006 | 0.005 | 0.04 | 0.014 | 7 | 120 | 0.005 |
| Present Steel 2 | 0.07 | 0.12 | 1.50 | 0.006 | 0.005 | 0.07 | 0.05 | 10 | 280 | 0.002 |
| Present Steel 3 | 0.14 | 0.10 | 1.48 | 0.006 | 0.005 | 0.06 | 0.015 | 3 | 110 | 0.003 |
| Present Steel 4 | 0.10 | 0.12 | 1.48 | 0.006 | 0.005 | 0.02 | 0.02 | 5 | 80 | 0.001 |
| Present Steel 5 | 0.08 | 0.15 | 1.52 | 0.006 | 0.004 | 0.09 | 0.05 | 15 | 300 | 0.002 |
| Present Steel 6 | 0.10 | 0.14 | 1.50 | 0.007 | 0.005 | 0.025 | 0.02 | 10 | 100 | 0.004 |
| Present Steel 7 | 0.13 | 0.14 | 1.48 | 0.007 | 0.005 | 0.04 | 0.015 | 8 | 115 | 0.15 |
| Present Steel 8 | 0.11 | 0.15 | 1.48 | 1.52 | 0.007 | 0.06 | 0.018 | 10 | 120 | 0.001 |
| Present Steel 9 | 0.13 | 0.21 | 1.50 | 0.007 | 0.005 | 0.025 | 0.02 | 4 | 90 | 0.002 |
| Present Steel 10 | 0.07 | 0.16 | 1.45 | 0.008 | 0.006 | 0.045 | 0.025 | 6 | 100 | 0.05 |
| Present Steel 11 | 0.12 | 0.13 | 1.54 | 0.006 | 0.005 | 0.04 | 0.014 | 7 | 120 | 0.005 |
| Conventional Steel 1 | 0.05 | 0.13 | 1.31 | 0.002 | 0.006 | 0.0014 | 0.009 | 1.6 | 22 | — |
| Conventional Steel 2 | 0.05 | 0.11 | 1.34 | 0.002 | 0.003 | 0.0036 | 0.012 | 0.5 | 48 | — |
| Conventional Steel 3 | 0.13 | 0.24 | 1.44 | 0.012 | 0.003 | 0.0044 | 0.010 | 1.2 | 127 | — |
| Conventional Steel 4 | 0.06 | 0.18 | 1.35 | 0.008 | 0.002 | 0.0027 | 0.013 | 8 | 32 | — |
| Conventional Steel 5 | 0.06 | 0.18 | 0.88 | 0.006 | 0.002 | 0.0021 | 0.013 | 5 | 20 | — |
| Conventional Steel 6 | 0.13 | 0.27 | 0.98 | 0.005 | 0.001 | 0.001 | 0.009 | 11 | 28 | — |
| Conventional Steel 7 | 0.13 | 0.24 | 1.44 | 0.004 | 0.002 | 0.02 | 0.008 | 8 | 79 | — |
| Conventional Steel 8 | 0.07 | 0.14 | 1.52 | 0.004 | 0.002 | 0.002 | 0.007 | 4 | 57 | — |
| Conventional Steel 9 | 0.06 | 0.25 | 1.31 | 0.008 | 0.002 | 0.019 | 0.007 | 10 | 91 | — |
| Conventional Steel 10 | 0.09 | 0.26 | 0.86 | 0.009 | 0.003 | 0.046 | 0.008 | 15 | 142 | — |
| Conventional Steel 11 | 0.14 | 0.44 | 1.35 | 0.012 | 0.012 | 0.030 | 0.049 | 7 | 89 | — |

| | Chemical Composition (wt %) | | | | | | | | |
|---|---|---|---|---|---|---|---|---|---|
| | Cu | Ni | Cr | Mo | Nb | V | Ca | REM | O (ppm) |
| Present Steel 1 | — | — | — | — | — | 0.01 | — | — | 25 |
| Present Steel 2 | — | 0.2 | — | — | — | 0.01 | — | — | 26 |
| Present Steel 3 | 0.1 | — | — | — | — | 0.02 | — | — | 22 |
| Present Steel 4 | — | — | — | — | — | 0.05 | — | — | 28 |
| Present Steel 5 | 0.1 | — | 0.1 | — | — | 0.05 | — | — | 32 |
| Present Steel 6 | — | — | — | 0.1 | — | 0.09 | — | — | 28 |
| Present Steel 7 | 0.1 | — | — | — | — | 0.02 | — | — | 29 |
| Present Steel 8 | — | — | — | — | 0.015 | 0.01 | — | — | 26 |
| Present Steel 9 | — | — | 0.1 | — | — | 0.02 | 0.001 | — | 26 |

TABLE 1-continued

| | | | | | | | | | |
|---|---|---|---|---|---|---|---|---|---|
| Present Steel 10 | — | 0.3 | — | — | 0.01 | 0.02 | — | 0.01 | 27 |
| Present Steel 11 | — | — | — | — | — | — | — | — | 25 |
| Conventional Steel 1 | — | — | — | — | — | — | — | — | 22 |
| Conventional Steel 2 | — | — | — | — | — | — | — | — | 32 |
| Conventional Steel 3 | 0.3 | — | — | — | 0.05 | — | — | — | 138 |
| Conventional Steel 4 | — | — | 0.14 | 0.15 | — | 0.028 | — | — | 26 |
| Conventional Steel 5 | 0.75 | 0.58 | 0.24 | 0.14 | 0.015 | 0.037 | — | — | 27 |
| Conventional Steel 6 | 0.35 | 1.15 | 0.53 | 0.49 | 0.001 | 0.045 | — | — | 25 |
| Conventional Steel 7 | 0.3 | — | — | — | 0.036 | — | — | | — |
| Conventional Steel 8 | 0.32 | 0.35 | — | — | 0.013 | — | — | — | — |
| Conventional Steel 9 | — | — | 0.21 | 0.19 | 0.025 | 0.035 | — | — | — |
| Conventional Steel 10 | — | 1.09 | 0.51 | 0.36 | 0.021 | 0.021 | — | — | — |
| Conventional Steel 11 | — | — | — | — | — | 0.069 | — | — | — |

The conventional steels 1, 2 and 3 are the inventive steels 5, 32, and 55 of Japanese Patent Laid-open Publication No. Hei. 9-194990.
The conventional steels 4, 5, and 6 are the inventive steels 14, 24, and 28 of Japanese Patent Laid-open Publication No. Hei. 10-298708.
The conventional steels 7, 8, 9, and 10 are the inventive steels 48, 58, 60, and 61 of Japanese Patent Laid-open Publication No. Hei. 8-60292.
The conventional steel 11 is the inventive steel F of Japanese Patent Laid-open Publication No. Hei. 11-140582.

TABLE 2

| | Content Ratios of Alloying Elements | | | | |
|---|---|---|---|---|---|
| | Ti/N | N/B | Al/N | V/N | (Ti + 2Al + 4B + V)/N |
| Present Steel 1 | 1.2 | 17.1 | 3.3 | 0.8 | 8.9 |
| Present Steel 2 | 1.8 | 28.0 | 2.5 | 0.4 | 7.3 |
| Present Steel 3 | 1.4 | 36.7 | 5.5 | 1.8 | 14.2 |
| Present Steel 4 | 2.5 | 16.0 | 2.5 | 6.3 | 14.0 |
| Present Steel 5 | 1.7 | 20.0 | 3.0 | 1.7 | 9.5 |
| Present Steel 6 | 2.0 | 10.0 | 2.5 | 9.0 | 16.4 |
| Present Steel 7 | 1.3 | 14.4 | 3.5 | 1.7 | 10.3 |
| Present Steel 8 | 1.5 | 12.0 | 5.0 | 0.8 | 12.7 |
| Present Steel 9 | 2.2 | 22.5 | 2.8 | 2.2 | 10.2 |
| Present Steel 10 | 2.5 | 16.7 | 4.5 | 2.0 | 13.7 |
| Present Steel 11 | 1.2 | 17.1 | 3.3 | — | 8.06 |
| Conventional Steel 1 | 4.1 | 13.8 | 0.6 | — | 5.7 |

TABLE 2-continued

| | Content Ratios of Alloying Elements | | | | |
|---|---|---|---|---|---|
| | Ti/N | N/B | Al/N | V/N | (Ti + 2Al + 4B + V)/N |
| Conventional Steel 2 | 2.5 | 96.0 | 0.8 | — | 4.0 |
| Conventional Steel 3 | 0.8 | 105.8 | 0.4 | — | 1.5 |
| Conventional Steel 4 | 4.1 | 4.0 | 0.8 | 8.8 | 15.5 |
| Conventional Steel 5 | 6.5 | 4.0 | 1.1 | 18.5 | 28.1 |
| Conventional Steel 6 | 3.2 | 2.6 | 0.4 | 16.1 | 21.6 |
| Conventional Steel 7 | 1.0 | 9.9 | 2.5 | — | 6.5 |
| Conventional Steel 8 | 1.2 | 14.3 | 0.4 | — | 2.2 |
| Conventional Steel 9 | 0.8 | 9.1 | 2.1 | 3.9 | 9.2 |
| Conventional Steel 10 | 0.6 | 9.5 | 3.2 | 1.5 | 8.9 |
| Conventional Steel 11 | 5.5 | 12.7 | 3.4 | 7.8 | 20.3 |

TABLE 3

| | | Heating Temp. (° C.) | Heating Time (min) | Rolling Start Temp. (° C.) | Rolling End Time(° C.) | Rolling reducton rate(%) | Cooling Rate (° C./min) |
|---|---|---|---|---|---|---|---|
| Present Steel 1 | Present Sample 1 | 1,200 | 120 | 1,030 | 850 | 75 | 3 |
| | Present Sample 2 | 1,100 | 180 | 1,030 | 850 | 75 | 3 |
| | Present Sample 3 | 1,250 | 60 | 1,030 | 850 | 75 | 3 |
| | Comparative Sample 3 | 1,000 | 60 | 1,030 | 850 | 75 | 3 |
| | Comparative Sample | 1,350 | 180 | 1,030 | 850 | 75 | 3 |
| Present Steel 2 | Present Sample 4 | 1,230 | 100 | 980 | 870 | 60 | 8 |
| Present Steel 3 | Present Sample 5 | 1,240 | 110 | 1,000 | 820 | 55 | 5 |
| Present Steel 4 | Present Sample 6 | 1,150 | 160 | 980 | 850 | 45 | 7 |
| Present Steel 5 | Present Sample 7 | 1,140 | 170 | 1,050 | 900 | 75 | 6 |
| Present Steel 6 | Present Sample 8 | 1,200 | 120 | 1,030 | 850 | 75 | 3 |
| Present Steel 7 | Present Sample 9 | 1,210 | 110 | 1,010 | 860 | 65 | 5 |
| Present Steel 8 | Present Sample 10 | 1,200 | 120 | 950 | 840 | 70 | 4 |

TABLE 3-continued

| | | Heating Temp. (° C.) | Heating Time (min) | Rolling Start Temp. (° C.) | Rolling End Time(° C.) | Rolling reducton rate(%) | Cooling Rate (° C./min) |
|---|---|---|---|---|---|---|---|
| Present Steel 9 | Present Sample 11 | 1,240 | 100 | 980 | 850 | 70 | 4 |
| Present Steel 10 | Present Sample 12 | 1,170 | 150 | 1,010 | 870 | 65 | 3 |
| Present Steel 11 | Present Sample 13 | 1,180 | 140 | 1,020 | 850 | 70 | 3 |
| Conventional Steel 11 | | 1,200 | — | $Ar_3$ Or more | 960 | 80 | Naturally Cooled |

There is no detailed manufacturing condition for the conventional steels 1 to 10.

Test pieces were sampled from the hot-rolled products. The sampling was performed at the central portion of each hot-rolled product in a thickness direction. In particular, test pieces for a tensile test were sampled in a rolling direction, whereas test pieces for a Charpy impact test were sampled in a direction perpendicular to the rolling direction.

Using steel test pieces sampled as described above, characteristics of precipitates in each steel product (matrix), and mechanical properties of the steel product were measured. The measured results are described in Table 4. Also, the microstructure and impact toughness of the heat affected zone were measured and described in Table 5. These measurements were carried out as follows.

For tensile test pieces, test pieces of KS Standard No. 4 (KS B 0801) were used. The tensile test was carried out at a cross head speed of 5 mm/min. On the other hand, impact test pieces were prepared, based on the test piece of KS Standard No. 3 (KS B 0809). For the impact test pieces, notches were machined at a side surface (L-T) in a rolling direction in the case of the matrix while being machined in a welding line direction in the case of the welding material. In order to inspect the size of austenite grains at a maximum heating temperature of the heat affected zone, each test piece was heated to a maximum heating temperature of 1,200 to 1,400° C. at a heating rate of 140° C./sec using a reproducible welding simulator, and then quenched using He gas after being maintained for one second. After the quenched test piece was polished and eroded, the grain size of austenite in the resultant test piece at a maximum heating temperature condition was measured in accordance with a KS Standard (KS D 0205).

The microstructure obtained after the cooling process, and the grain sizes, densities, and spacing of TiN precipitates seriously influencing the toughness of the heat affected zone were measured in accordance with a point counting scheme using an image analyzer and an electronic microscope. The measurement was carried out for a test area of 100 $mm^2$.

The impact toughness of the heat affected zone in each test piece was evaluated by subjecting the test piece to welding conditions corresponding to welding heat inputs of about 80 kJ/cm, 150 kJ/cm, and 250 kJ/cm, that is, welding cycles involving heating at a maximum heating temperature of 1,400° C., and cooling from 800° C. to 500° C. for 60 seconds, 120 seconds, and 180 seconds, respectively, polishing the surface of the test piece, machining the test piece for an impact test, and then conducting a Charpy impact test for the test piece at a temperature of −40° C.

TABLE 4

| | Characteristics of Precipitates | | | Mechanical Properties and Ferrite Fraction of Matrix | | | | | | |
|---|---|---|---|---|---|---|---|---|---|---|
| Sample | Density (number/$mm^2$) | Mean Size (μm) | Spacing (μm) | Thickness (mm) | Yield Strength (MPa) | Tensile Strength (MPa) | Elongation (%) | FGS (μm) | Volume Fraction of Ferrite (%) | −40° C. Impact Toughness (J) |
| PS 1 | $3.2 \times 10^8$ | 0.019 | 0.35 | 25 | 354 | 472 | 42 | 11 | 82 | 375 |
| PS 2 | $3.8 \times 10^8$ | 0.017 | 0.32 | 25 | 360 | 488 | 41 | 9 | 83 | 388 |
| PS 3 | $3.5 \times 10^8$ | 0.014 | 0.36 | 25 | 362 | 483 | 41 | 10 | 83 | 386 |
| CS 1 | $2.4 \times 10^6$ | 0.158 | 1.71 | 25 | 346 | 475 | 40 | 11 | 76 | 315 |
| CS 2 | $1.3 \times 10^6$ | 0.182 | 1.84 | 25 | 361 | 496 | 39 | 11 | 75 | 287 |
| PS 4 | $3.2 \times 10^8$ | 0.025 | 0.32 | 30 | 353 | 484 | 41 | 11 | 80 | 380 |
| PS 5 | $2.6 \times 10^8$ | 0.022 | 0.35 | 30 | 366 | 487 | 38 | 10 | 81 | 386 |
| PS 6 | $3.4 \times 10^8$ | 0.029 | 0.28 | 30 | 370 | 482 | 41 | 10 | 82 | 376 |
| PS 7 | $3.8 \times 10^8$ | 0.025 | 0.25 | 35 | 344 | 464 | 38 | 10 | 85 | 382 |
| PS 8 | $4.6 \times 10^8$ | 0.019 | 0.29 | 35 | 367 | 482 | 42 | 11 | 82 | 379 |
| PS 9 | $5.5 \times 10^8$ | 0.017 | 0.31 | 35 | 383 | 507 | 42 | 10 | 84 | 383 |
| PS 10 | $5.4 \times 10^8$ | 0.023 | 0.32 | 35 | 372 | 492 | 41 | 11 | 83 | 392 |
| PS 11 | $3.6 \times 10^8$ | 0.019 | 0.26 | 40 | 373 | 487 | 40 | 12 | 83 | 381 |
| PS 12 | $3.2 \times 10^8$ | 0.018 | 0.32 | 40 | 364 | 482 | 38 | 11 | 82 | 376 |
| PS 13 | $3.2 \times 10^8$ | 0.019 | 0.35 | 25 | 354 | 472 | 42 | 11 | 82 | 375 |
| CS* 1 | | | | 35 | 406 | 438 | | | | |
| CS* 2 | | | | 35 | 405 | 441 | | | | |
| CS* 3 | | | | 25 | 681 | 629 | | | | |
| CS* 4 | Precipitates of MgO—TiN 3.03 × $10^6$/$mm^2$ | | | 40 | 472 | 609 | | | | 203 (0° C.) |

TABLE 4-continued

| Sample | Characteristics of Precipitates: Density (number/mm$^2$) | Mean Size (μm) | Spacing (μm) | Mechanical Properties and Ferrite Fraction of Matrix: Thickness (mm) | Yield Strength (MPa) | Tensile Strength (MPa) | Elongation (%) | FGS (μm) | Volume Fraction of Ferrite (%) | −40° C. Impact Toughness (J) |
|---|---|---|---|---|---|---|---|---|---|---|
| CS* 5 | Precipitates of MgO—TiN $4.07 \times 10^6$/mm$^2$ | | | 40 | 494 | 622 | 32 | | | 206 (0° C.) |
| CS* 6 | Precipitates of MgO—TiN $2.80 \times 10^6$/mm$^2$ | | | 50 | 812 | 912 | 28 | | | 268 (0° C.) |
| CS* 7 | | | | 40 | 475 | 532 | — | | | |
| CS* 8 | | | | 50 | 504 | 601 | — | | | |
| CS* 9 | | | | 60 | 526 | 648 | | | | |
| CS* 10 | | | | 60 | 760 | 829 | | | | |
| CS* 11 | 0.2 μm or less: $11.1 \times 10^3$ | | | 50 | 401 | 514 | | | | 301 (0° C.) |

FGS: Grain Size of Ferrite
PS: Present Sample
CS: Comparative Sample
CS*: Conventional Steel Referring to Table 4, it can be seen that the density of precipitates (TiN precipitates) in each hot-rolled product manufactured in accordance with the present invention is $2.8\times10^8$/mm$^2$ or more, whereas the density of precipitates in each conventional product is $11.1\times10^3$/mm$^2$ or less. That is, the product of the present invention is formed with precipitates having a very small grain size while being dispersed at a considerably uniform and increased density.

TABLE 5

| Sample | Grain Size of Austenite in Heat Affected Zone (μm): 1,200 (° C.) | 1,300 (° C.) | 1400 (° C.) | Microstructure of Heat Affected Zone with Heat Input of 100 kJ/cm: Volume Fraction of Ferrite (%) | Mean Grain Size of Ferrite (μm) | Reproducible Heat Affected Zone Impact Toughness (J) at −40° C. (Maximum Heating Temp. 1,400° C.): $\Delta t_{800\text{-}500}$ = 60 sec: Impact Toughness (J) | Transition Temp. (° C.) | $\Delta t_{800\text{-}500}$ = 120 sec: Impact Toughness (J) | Transition Temp. (° C.) | $\Delta t_{800\text{-}500}$ = 180 sec: Impact Toughness (J) | Transition Temp. (° C.) |
|---|---|---|---|---|---|---|---|---|---|---|---|
| PS 1 | 23 | 34 | 56 | 74 | 15 | 372 | −74 | 332 | −67 | 293 | −63 |
| PS 2 | 22 | 35 | 55 | 77 | 13 | 384 | −76 | 350 | −69 | 302 | −64 |
| PS 3 | 23 | 35 | 56 | 75 | 13 | 366 | −72 | 330 | −67 | 295 | −63 |
| CS 1 | 54 | 86 | 182 | 38 | 24 | 124 | −43 | 43 | −34 | 28 | −28 |
| CS 2 | 65 | 92 | 198 | 36 | 26 | 102 | −40 | 30 | −32 | 17 | −25 |
| PS 4 | 25 | 38 | 63 | 76 | 14 | 353 | −71 | 328 | −68 | 284 | −65 |
| PS 5 | 26 | 41 | 57 | 78 | 15 | 365 | −71 | 334 | −67 | 295 | −62 |
| PS 6 | 25 | 32 | 53 | 75 | 14 | 383 | −73 | 354 | −69 | 303 | −63 |
| PS 7 | 24 | 35 | 55 | 77 | 14 | 365 | −71 | 337 | −67 | 292 | −63 |
| PS 8 | 27 | 37 | 53 | 74 | 13 | 362 | −71 | 339 | −67 | 296 | −62 |
| PS 9 | 24 | 36 | 52 | 78 | 15 | 368 | −72 | 330 | −67 | 284 | −63 |
| PS 10 | 22 | 34 | 53 | 75 | 14 | 383 | −72 | 345 | −66 | 293 | −63 |
| PS 11 | 26 | 35 | 64 | 75 | 14 | 356 | −71 | 328 | −68 | 282 | −68 |
| PS 12 | 27 | 39 | 64 | 74 | 15 | 353 | −71 | 321 | −67 | 276 | −62 |
| PS 13 | 23 | 34 | 56 | 74 | 15 | 372 | −74 | 332 | −67 | 293 | −63 |
| CS* 1 | | | | | | | | | | | |
| CS* 2 | | | | | | | | | | | |
| CS* 3 | | | | | | | | | | | |
| CS* 4 | | 230 | | 93 | | | | | | 132 (0° C.) | |
| CS* 5 | | 180 | | 87 | | | | | | 129 (0° C.) | |
| CS* 6 | | 250 | | 47 | | | | | | 60 (0° C.) | |
| CS* 7 | | | | | | | −60 | | | | −61 |
| CS* 8 | | | | | | | −59 | | | | −48 |
| CS* 9 | | | | | | | −54 | | | | −42 |

TABLE 5-continued

| Sample | Grain Size of Austenite in Heat Affected Zone (μm) 1,200 (° C.) | 1,300 (° C.) | 1400 (° C.) | Microstructure of Heat Affected Zone with Heat Input of 100 kJ/cm: Volume Fraction of Ferrite (%) | Mean Grain Size of Ferrite (μm) | Reproducible Heat Affected Zone Impact Toughness (J) at −40° C. (Maximum Heating Temp. 1,400° C.): $\Delta t_{800-500}$ = 60 sec Impact Toughness (J) | Transition Temp. (° C.) | $\Delta t_{800-500}$ = 120 sec Impact Toughness (J) | Transition Temp. (° C.) | $\Delta t_{800-500}$ = 180 sec Impact Toughness (J) | Transition Temp. (° C.) |
|---|---|---|---|---|---|---|---|---|---|---|---|
| CS* 10 | | | | | | | −57 | | | | −45 |
| CS* 11 | | | | | | | | | 219 (0° C.) | | |

PS: Present Sample
CS: Comparative Sample
CS*: Conventional Steel

Referring to Table 5, it can be seen that the size of austenite grains in the heat affected zone under a maximum heating temperature condition of 1,400° C. is within a range of about 52 to 65 μm in the case of the present invention, whereas the austenite grains in the conventional products (Conventional Steels 4 to 6) have a grain size of about 180 μm. Thus, the steel products of the present invention have a superior effect of suppressing the growth of austenite grains at the heat affected zone.

Under a high heat input welding condition in which the time taken for cooling from 800° C. to 500° C. is 180 seconds, the products of the present invention exhibit a superior toughness value of about 280 J or more as a heat affected zone impact toughness while exhibiting about −60° C. as a transition temperature.

Example 2

Control of Deoxidation: Nitrogenizing Treatment

Each of steel products having different steel compositions of Table 6 was melted in a converter. The resultant molten steel was cast after being subjected to refining and deoxidizing treatments under the conditions of Table 7, thereby forming a steel slab. The slab was then hot rolled under the condition of Table 9, thereby manufacturing a hot-rolled plate. Table 8 describes content ratios of alloying elements in each steel product.

TABLE 6

| | Chemical Composition (wt %) C | Si | Mn | P | S | Al | Ti | B(ppm) | N(ppm) | W |
|---|---|---|---|---|---|---|---|---|---|---|
| Present Steel 1 | 0.12 | 0.13 | 1.54 | 0.006 | 0.05 | 0.04 | 0.014 | 7 | 120 | 0.005 |
| Present Steel 2 | 0.07 | 0.12 | 1.50 | 0.006 | 0.005 | 0.07 | 0.05 | 10 | 280 | 0.002 |
| Present Steel 3 | 0.14 | 0.10 | 1.48 | 0.006 | 0.005 | 0.06 | 0.015 | 3 | 110 | 0.003 |
| Present Steel 4 | 0.10 | 0.12 | 1.48 | 0.006 | 0.005 | 0.02 | 0.02 | 5 | 80 | 0.001 |
| Present Steel 5 | 0.08 | 0.15 | 1.52 | 0.006 | 0.004 | 0.09 | 0.05 | 15 | 300 | 0.002 |
| Present Steel 6 | 0.10 | 0.14 | 1.50 | 0.007 | 0.005 | 0.025 | 0.02 | 10 | 100 | 0.004 |
| Present Steel 7 | 0.13 | 0.14 | 1.48 | 0.007 | 0.005 | 0.04 | 0.015 | 8 | 115 | 0.15 |
| Present Steel 8 | 0.11 | 0.15 | 1.52 | 0.007 | 0.005 | 0.06 | 0.018 | 10 | 120 | 0.001 |
| Present Steel 9 | 0.13 | 0.21 | 1.50 | 0.007 | 0.005 | 0.025 | 0.02 | 4 | 90 | 0.002 |
| Present Steel 10 | 0.07 | 0.16 | 1.45 | 0.008 | 0.06 | 0.045 | 0.025 | 6 | 100 | 0.05 |
| Present Steel 11 | 0.11 | 0.21 | 1.52 | 0.008 | 0.005 | 0.051 | 0.017 | 9 | 130 | 0.01 |
| Conventional Steel 1 | 0.05 | 0.13 | 1.31 | 0.002 | 0.006 | 0.0014 | 0.009 | 1.6 | 22 | — |
| Conventional Steel 2 | 0.05 | 0.11 | 1.34 | 0.002 | 0.003 | 0.0036 | 0.012 | 0.5 | 48 | — |
| Conventional Steel 3 | 0.13 | 0.24 | 1.44 | 0.012 | 0.003 | 0.0044 | 0.010 | 1.2 | 127 | — |
| Conventional Steel 4 | 0.06 | 0.18 | 1.35 | 0.008 | 0.002 | 0.0027 | 0.013 | 8 | 32 | — |
| Conventional Steel 5 | 0.06 | 0.18 | 0.88 | 0.006 | 0.002 | 0.0021 | 0.013 | 5 | 20 | — |
| Conventional Steel 6 | 0.13 | 0.27 | 0.98 | 0.005 | 0.001 | 0.001 | 0.009 | 11 | 28 | — |
| Conventional Steel 7 | 0.13 | 0.24 | 1.44 | 0.004 | 0.002 | 0.02 | 0.008 | 8 | 79 | — |
| Conventional Steel 8 | 0.07 | 0.14 | 1.52 | 0.004 | 0.002 | 0.002 | 0.007 | 4 | 57 | — |
| Conventional Steel 9 | 0.06 | 0.25 | 1.31 | 0.008 | 0.002 | 0.019 | 0.007 | 10 | 91 | — |
| Conventional Steel 10 | 0.09 | 0.26 | 0.86 | 0.009 | 0.003 | 0.046 | 0.008 | 15 | 142 | — |
| Conventional Steel 11 | 0.14 | 0.44 | 1.35 | 0.012 | 0.012 | 0.030 | 0.049 | 7 | 89 | — |

| | Chemical Composition (wt %) Cu | Ni | Cr | Mo | Nb | V | Ca | REM | O (ppm) |
|---|---|---|---|---|---|---|---|---|---|
| Present Steel 1 | — | — | — | — | — | 0.01 | — | — | 11 |
| Present Steel 2 | 0.1 | 0.2 | — | — | — | 0.01 | — | — | 12 |

TABLE 6-continued

| | | | | | | | | | |
|---|---|---|---|---|---|---|---|---|---|
| Present Steel 3 | 0.1 | — | — | — | — | 0.02 | — | — | 10 |
| Present Steel 4 | — | — | — | — | — | 0.05 | — | — | 9 |
| Present Steel 5 | 0.1 | — | 0.1 | — | — | 0.05 | — | — | 12 |
| Present Steel 6 | — | — | — | 0.1 | — | 0.09 | — | — | 9 |
| Present Steel 7 | 0.1 | — | — | — | — | 0.02 | — | — | 11 |
| Present Steel 8 | — | — | — | — | 0.015 | 0.01 | — | — | 10 |
| Present Steel 9 | — | — | 0.1 | — | — | 0.02 | 0.001 | — | 12 |
| Present Steel 10 | — | 0.3 | — | — | 0.01 | 0.02 | — | 0.01 | 8 |
| Present Steel 11 | — | 0.1 | — | — | — | — | — | — | 13 |
| Conventional Steel 1 | — | — | — | — | — | — | — | — | 22 |
| Conventional Steel 2 | — | — | — | — | — | — | — | — | 32 |
| Conventional Steel 3 | 0.3 | — | — | — | 0.05 | — | — | — | 138 |
| Conventional Steel 4 | — | — | 0.14 | 0.15 | — | 0.028 | — | — | 25 |
| Conventional Steel 5 | 0.75 | 0.58 | 0.24 | 0.14 | 0.015 | 0.037 | — | — | 27 |
| Conventional Steel 6 | 0.35 | 1.15 | 0.53 | 0.49 | 0.001 | 0.045 | — | — | 25 |
| Conventional Steel 7 | 0.3 | — | — | — | 0.036 | — | — | | — |
| Conventional Steel 8 | 0.32 | 0.35 | — | — | 0.013 | — | — | — | — |
| Conventional Steel 9 | — | — | 0.21 | 0.19 | 0.025 | 0.035 | — | — | — |
| Conventional Steel 10 | — | 1.09 | 0.51 | 0.36 | 0.021 | 0.021 | — | — | — |
| Conventional Steel 11 | — | — | — | — | — | 0.069 | — | — | — |

The conventional steels 1, 2 and 3 are the inventive steels 5, 32, and 55 of Japanese Patent Laid-open Publication No. Hei. 9-194990.
The conventional steels 4, 5, and 6 are the inventive steels 14, 24, and 28 of Japanese Patent Laid-open Publication No. Hei. 10-298708.
The conventional steels 7, 8, 9, and 10 are the inventive steels 48, 58, 60, and 61 of Japanese Patent Laid-open Publication No. Hei. 8-60292.
The conventional steel 11 is the inventive steel F of Japanese Patent Laid-open Publication No. Hei. 11-140582.

TABLE 7

| Steel Products | Sample | Primary Deoxidation Order | Dissolved Oxygen Amount after Addition of Al (ppm) | Amount of Ti Added after Deoxidation (%) | Casting Speed (m/min) | Water Spray Amount (l/kg) |
|---|---|---|---|---|---|---|
| PS* 1 | PS 1 | Mn→ Si | 19 | 0.015 | 1.04 | 0.33 |
| PS* 2 | PS 2 | Mn→ Si | 23 | 0.052 | 1.02 | 0.35 |
| PS* 3 | PS 3 | Mn→ Si | 21 | 0.016 | 1.10 | 0.33 |
| PS* 4 | PS 4 | Mn→ Si | 18 | 0.023 | 1.03 | 0.34 |
| PS* 5 | PS 5 | Mn→ Si | 17 | 0.054 | 1.07 | 0.34 |
| PS* 6 | PS 6 | Mn→ Si | 18 | 0.023 | 0.96 | 0.34 |
| PS* 7 | PS 7 | Mn→ Si | 21 | 0.016 | 0.96 | 0.34 |
| PS* 8 | PS 8 | Mn→ Si | 24 | 0.019 | 0.98 | 0.33 |
| PS* 9 | PS 9 | Mn→ Si | 19 | 0.022 | 0.95 | 0.33 |
| PS* 10 | PS 10 | Mn→ Si | 23 | 0.027 | 1.06 | 0.33 |
| PS* 11 | PS 11 | Mn→ Si | 24 | 0.018 | 1.08 | 0.32 |

There is no detailed manufacturing condition for the conventional steels 1 to 11.
PS: Present Sample
PS*: Present Steel

TABLE 8

| | Content Ratios of Alloying Elements | | | | |
|---|---|---|---|---|---|
| Steel Products | Ti/N | N/B | Al/N | V/N | (Ti + 2Al + 4B + V)/N |
| Present Steel 1 | 1.2 | 17.1 | 3.3 | 0.8 | 8.9 |
| Present Steel 2 | 1.8 | 28.0 | 2.5 | 0.4 | 7.3 |
| Present Steel 3 | 1.4 | 36.7 | 5.5 | 1.8 | 14.2 |
| Present Steel 4 | 2.5 | 16.0 | 2.5 | 6.3 | 14.0 |
| Present Steel 5 | 1.7 | 20.0 | 3.0 | 1.7 | 9.5 |
| Present Steel 6 | 2.0 | 10.0 | 2.5 | 9.0 | 16.4 |
| Present Steel 7 | 1.3 | 14.4 | 3.5 | 1.7 | 10.3 |
| Present Steel 8 | 1.5 | 12.0 | 5.0 | 0.8 | 12.7 |
| Present Steel 9 | 2.2 | 22.5 | 2.8 | 2.2 | 10.2 |
| Present Steel 10 | 2.5 | 16.7 | 4.5 | 2.0 | 13.7 |
| Present Steel 11 | 1.3 | 14.4 | 3.9 | — | 9.4 |
| Conventional Steel 1 | 4.1 | 13.8 | 0.6 | — | 5.7 |
| Conventional Steel 2 | 2.5 | 96.0 | 0.8 | — | 4.0 |
| Conventional Steel 3 | 0.8 | 105.8 | 0.4 | — | 1.5 |
| Conventional Steel 4 | 4.1 | 4.0 | 0.8 | 8.8 | 15.5 |
| Conventional Steel 5 | 6.5 | 4.0 | 1.1 | 18.5 | 28.1 |
| Conventional Steel 6 | 3.2 | 2.6 | 0.4 | 16.1 | 21.6 |
| Conventional Steel 7 | 1.0 | 9.9 | 2.5 | — | 6.5 |
| Conventional Steel 8 | 1.2 | 14.3 | 0.4 | — | 2.2 |
| Conventional Steel 9 | 0.8 | 9.1 | 2.1 | 3.9 | 9.2 |
| Conventional Steel 10 | 0.6 | 9.5 | 3.2 | 1.5 | 8.9 |
| Conventional Steel 11 | 5.5 | 12.7 | 3.4 | 7.8 | 20.3 |

TABLE 9

| Steel Products | Sample | Heating Temp. (° C.) | Heating Time (min) | Rolling Start Temp. (° C.) | Rolling End Temp. (° C.) | Rolling Reduction Rate (%) | Rolling Reduction Rate in Recrystallization Range (%) | Cooling Rate (° C./min) | Cooling End Time(° C.) |
|---|---|---|---|---|---|---|---|---|---|
| PS 1 | PE 1 | 1,150 | 170 | 1,000 | 820 | 85 | 50 | 15 | 550 |
| | PE 2 | 1,200 | 120 | 1,010 | 830 | 85 | 50 | 15 | 540 |
| | PE 3 | 1,250 | 70 | 1,020 | 830 | 85 | 50 | 15 | 540 |
| | CE 1 | 1,000 | 60 | 950 | 820 | 85 | 50 | 15 | 535 |
| | CE 2 | 1,400 | 350 | 1,200 | 830 | 85 | 50 | 14 | 540 |
| PS 2 | PE 4 | 1,220 | 125 | 1,030 | 850 | 80 | 45 | 15 | 540 |
| PS 3 | PE 5 | 1,210 | 130 | 1,020 | 820 | 80 | 45 | 16 | 530 |
| PS 4 | PE 6 | 1,240 | 120 | 1,020 | 800 | 80 | 45 | 17 | 550 |

TABLE 9-continued

| Steel Products | Sample | Heating Temp. (° C.) | Heating Time (min) | Rolling Start Temp. (° C.) | Rolling End Temp. (° C.) | Rolling Reduction Rate (%) | Rolling Reduction Rate in Recrystallization Range (%) | Cooling Rate (° C./min) | Cooling End Time(° C.) |
|---|---|---|---|---|---|---|---|---|---|
| PS 5 | PE 7 | 1,190 | 150 | 1,010 | 810 | 80 | 45 | 16 | 540 |
| PS 6 | PE 8 | 1,190 | 150 | 1,020 | 820 | 75 | 45 | 16 | 530 |
| PS 7 | PE 9 | 1,180 | 160 | 1,030 | 820 | 75 | 45 | 15 | 545 |
| PS 8 | PE 10 | 1,210 | 130 | 1,000 | 820 | 75 | 45 | 15 | 540 |
| PS 9 | PE 11 | 1,220 | 130 | 990 | 830 | 75 | 45 | 17 | 540 |
| PS 10 | PE 12 | 1,230 | 140 | 990 | 810 | 75 | 45 | 18 | 540 |
| PS 11 | PE 13 | 1,220 | 130 | 1,030 | 820 | 75 | 45 | 18 | 540 |
| Conventional Steel 11 | | 1,200 | — | $Ar_3$ or more | 960 | 80 | 45 | Naturally Cooled | 540 |

There is no detailed manufacturing condition for the conventional steels 1 to 11.
PS: Present Sample
PE: Present Example
CE: Comparative Example Test pieces were sampled from the hot-rolled steel plates manufactured as described above. The sampling was performed at the central portion of each rolled product in a thickness direction. In particular, test pieces for a tensile test were sampled in a rolling direction, whereas test pieces for a Charpy impact test were sampled in a direction perpendicular to the rolling direction.

Using steel test pieces sampled as described above, characteristics of precipitates in each steel product (matrix), and mechanical properties of the steel product were measured. The results are described in Table 10. Also, the microstructure and impact toughness of the heat affected zone were measured. The results are described in Table 11. These measurements were carried out in the same manner as in Example 1.

TABLE 10

| | Characteristics of Precipitates | | | Characteristics of Matrix Structure | | | | |
|---|---|---|---|---|---|---|---|---|
| | | | | | | | | −40° C. |
| Sample | Density (number/mm$^2$) | Mean Size (μm) | Spacing (μm) | Thickness (mm) | Yield Strength (MPa) | Tensile Strength (MPa) | Elongation (%) | Impact Toughness (J) |
| PE 1 | $2.8 \times 10^8$ | 0.018 | 0.25 | 25 | 352 | 474 | 43.4 | 354 |
| PE 2 | $3.1 \times 10^8$ | 0.015 | 0.35 | 25 | 356 | 480 | 42.6 | 364 |
| PE 3 | $2.9 \times 10^8$ | 0.010 | 0.35 | 25 | 356 | 483 | 42.2 | 365 |
| CE 1 | $4.1 \times 10^6$ | 0.157 | 1.7 | 25 | 342 | 470 | 41.0 | 284 |
| CE 2 | $5.7 \times 10^6$ | 0.158 | 1.5 | 25 | 365 | 492 | 40.5 | 274 |
| PE 4 | $3.9 \times 10^8$ | 0.021 | 0.34 | 25 | 356 | 480 | 42.6 | 354 |
| PE 5 | $2.4 \times 10^8$ | 0.017 | 0.32 | 25 | 356 | 481 | 39.7 | 348 |
| PE 6 | $3.1 \times 10^8$ | 0.027 | 0.28 | 30 | 350 | 483 | 40.5 | 346 |
| PE 7 | $4.8 \times 10^8$ | 0.021 | 0.26 | 30 | 340 | 465 | 38.9 | 352 |
| PE 8 | $4.2 \times 10^8$ | 0.017 | 0.31 | 30 | 362 | 481 | 43.2 | 357 |
| PE 9 | $5.4 \times 10^8$ | 0.018 | 0.30 | 30 | 381 | 506 | 42.4 | 348 |
| PE 10 | $5.3 \times 10^8$ | 0.021 | 0.25 | 30 | 374 | 496 | 42.1 | 332 |
| PE 11 | $3.8 \times 10^8$ | 0.019 | 0.27 | 40 | 370 | 489 | 41.4 | 362 |
| PE 12 | $3.1 \times 10^8$ | 0.015 | 0.31 | 40 | 346 | 482 | 41.6 | 342 |
| PE 13 | $2.5 \times 10^8$ | 0.018 | 0.32 | 35 | 348 | 485 | 41.5 | 339 |
| CS 1 | | | | 35 | 406 | 438 | — | |
| CS 2 | | | | 35 | 405 | 441 | — | |
| CS 3 | | | | 25 | 681 | 629 | — | |
| CS 4 | Precipitates of MgO—TiN $3.03 \times 10^6$/mm$^2$ | | | 40 | 472 | 609 | 32 | |
| CS 5 | Precipitates of MgO—TiN $4.07 \times 10^6$/mm$^2$ | | | 40 | 494 | 622 | 32 | |
| CS 6 | Precipitates of MgO—TiN $2.80 \times 10^6$/mm$^2$ | | | 50 | 812 | 912 | 28 | |
| CS 7 | | | | 25 | 475 | 532 | — | |
| CS 8 | | | | 50 | 504 | 601 | — | |
| CS 9 | | | | 60 | 526 | 648 | — | |
| CS 10 | | | | 60 | 760 | 829 | — | |
| CS 11 | 0.2 μm or less $11.1 \times 10^3$ | | | 50 | 401 | 514 | 18.3 | |

PE: Present Example
CE: Comparative Example
CS: Conventional Steel

Referring to Table 10, the density of precipitates (Ti-based nitrides) in each hot-rolled product manufactured in accordance with the present invention is $2.8\times10^8/mm^2$ or more, whereas the density of precipitates in the conventional products (in particular, Conventional Steel 11) is $11.1\times10^3/mm^2$ or less. That is, it can be seen that the product of the present invention is formed with precipitates having a very small grain size while being dispersed at a considerably uniform and increased density.

TABLE 11

| | Grain Size of Austenite in Heat Affected Zone (μm) | | | Microstructure of Heat Affected Zone with Heat Input of 100 kJ/cm | | Reproducible Heat Affected Zone Impact Toughness (J) at −40° C. (Maximum Heating Temp. 1,400° C.) | | | | | |
|---|---|---|---|---|---|---|---|---|---|---|---|
| | | | | Volume Fraction of | Mean Grain Size of | $\Delta t_{800\text{-}500}$ = 60 sec | | $\Delta t_{800\text{-}500}$ = 120 sec | | $\Delta t_{800\text{-}500}$ = 180 sec | |
| Samples | 1,200 (° C.) | 1,300 (° C.) | 1400 (° C.) | Ferrite (%) | Ferrite (μm) | Yield Strength ($kg/mm^2$) | Tensile Strength ($kg/mm^2$) | Impact Toughness (J) | Transition Temp. (° C.) | Impact Toughness (J) | Transition Temp. (° C.) |
| PE 1 | 23 | 34 | 57 | 78 | 18 | 377 | −75 | 332 | −66 | 290 | −60 |
| PE 2 | 22 | 35 | 55 | 76 | 17 | 386 | −78 | 350 | −69 | 304 | −62 |
| PE 3 | 23 | 35 | 58 | 78 | 18 | 364 | −73 | 330 | −65 | 297 | −61 |
| CE 1 | 54 | 86 | 186 | 38 | 28 | 121 | −41 | 43 | −34 | 24 | −28 |
| CE 2 | 65 | 92 | 202 | 34 | 26 | 103 | −45 | 30 | −32 | 19 | −25 |
| PE 4 | 25 | 38 | 62 | 87 | 17 | 352 | −70 | 328 | −65 | 287 | −59 |
| PE 5 | 26 | 41 | 58 | 84 | 16 | 368 | −72 | 334 | −66 | 299 | −60 |
| PE 6 | 25 | 32 | 52 | 85 | 17 | 389 | −75 | 354 | −69 | 306 | −62 |
| PE 7 | 24 | 35 | 58 | 83 | 15 | 363 | −72 | 337 | −67 | 294 | −60 |
| PE 8 | 27 | 37 | 54 | 84 | 17 | 369 | −73 | 339 | −67 | 293 | −60 |
| PE 9 | 24 | 36 | 53 | 82 | 16 | 367 | −73 | 330 | −64 | 287 | −59 |
| PE 10 | 22 | 34 | 55 | 78 | 18 | 382 | −72 | 345 | −65 | 298 | −61 |
| PE 11 | 26 | 35 | 63 | 80 | 17 | 354 | −71 | 328 | −64 | 285 | −59 |
| PE 12 | 27 | 39 | 65 | 77 | 17 | 350 | −71 | 321 | −64 | 276 | −58 |
| PE 13 | 25 | 38 | 62 | 81 | 18 | 362 | −72 | 324 | −65 | 287 | −63 |
| CS 1 | | | | | | | −58 | | | | |
| CS 2 | | | | | | | −55 | | | | |
| CS 3 | | | | | | | −54 | | | | |
| CS 4 | | 230 | | 93 | | | | | | 132 (0° C.) | |
| CS 5 | | 180 | | 87 | | | | | | 129 (0° C.) | |
| CS 6 | | 250 | | 47 | | | | | | 60 (0° C.) | |
| CS 7 | | | | | | | −60 | | | | −61 |
| CS 8 | | | | | | | −59 | | | | −48 |
| CS 9 | | | | | | | −54 | | | | −42 |
| CS 10 | | | | | | | −57 | | | | −45 |
| CS 11 | | | | | | | | | 219 (0° C.) | | |

PE: Present Example
CE: Comparative Example
CS: Conventional Steel

Referring to Table 11, it can be seen that the size of austenite grains in the heat affected zone under a maximum heating temperature of 1,400° C. is within a range of about 52 to 65 μm in the case of the present invention, whereas the austenite grains in the conventional products (in particular, Conventional Steels 4 to 6) have a grain size of about 180 μm. Thus, the steel products of the present invention have a superior effect of suppressing the growth of austenite grains at the heat affected zone.

Under a high heat input welding condition in which the time taken for cooling from 800° C. to 500° C. is 180 seconds, the products of the present invention exhibit a superior toughness value of about 280 J or more as a heat affected zone impact toughness while exhibiting about −60° C. as a transition temperature.

Example 3

Nitrogenizing Treatment

In order to obtain steel slabs having diverse compositions described in Table 12, steels of the present invention in which their elements except for Ti were within ranges of the present invention, respectively, were used as samples. Each sample was melted in a converter. The resultant molten steel was slightly deoxidized using Mn or Si, and then heavily deoxidized using Al, thereby controlling the amount of dissolved oxygen. An addition of Ti was then carried out in order to control the concentration of Ti, as shown in Table 12. The molten metal was subjected to a degassing treatment, and then continuously cast at a controlled casting rate. Thus, a steel slab was manufactured. At this time, the deoxidizing element, the deoxidizing order, the amount of dissolved oxygen, the casting condition, and the amount of added Ti after completion of deoxidation are described in Table 13.

Each steel slab obtained as described above was nitrogenized while being heated in a heating furnace under the conditions of Table 14. The resultant steel slab was hot-rolled at a rolling reduction rate of 70% or more, thereby obtaining a thick steel plate having a thickness of 25 to 40 mm. Table 16 describes content ratios of alloying elements in each steel product subjected to a nitrogenizing treatment.

TABLE 12

| | Chemical Composition (wt %) | | | | | | | | | |
|---|---|---|---|---|---|---|---|---|---|---|
| | C | Si | Mn | P | S | Al | Ti | B(ppm) | N(ppm) | W |
| Present Steel 1 | 0.11 | 0.23 | 1.55 | 0.006 | 0.005 | 0.05 | 0.015 | 9 | 45 | 0.005 |
| Present Steel 2 | 0.13 | 0.14 | 1.52 | 0.006 | 0.08 | 0.0045 | 0.05 | 11 | 43 | 0.001 |
| Present Steel 3 | 0.14 | 0.20 | 1.48 | 0.006 | 0.005 | 0.06 | 0.014 | 3 | 39 | 0.003 |
| Present Steel 4 | 0.10 | 0.12 | 1.48 | 0.007 | 0.004 | 0.03 | 0.03 | 5 | 49 | 0.001 |
| Present Steel 5 | 0.07 | 0.25 | 1.54 | 0.007 | 0.005 | 0.09 | 0.05 | 15 | 42 | 0.002 |
| Present Steel 6 | 0.14 | 0.24 | 1.52 | 0.008 | 0.006 | 0.025 | 0.02 | 9 | 47 | 0.004 |
| Present Steel 7 | 0.12 | 0.15 | 1.51 | 0.007 | 0.005 | 0.04 | 0.016 | 8 | 45 | 0.15 |
| Present Steel 8 | 0.13 | 0.25 | 1.52 | 0.08 | 0.004 | 0.06 | 0.018 | 10 | 38 | 0.001 |
| Present Steel 9 | 0.12 | 0.21 | 1.40 | 0.07 | 0.005 | 0.025 | 0.02 | 5 | 37 | 0.002 |
| Present Steel 10 | 0.08 | 0.23 | 1.52 | 0.008 | 0.006 | 0.045 | 0.025 | 10 | 41 | 0.05 |
| Present Steel 11 | 0.15 | 0.23 | 1.54 | 0.006 | 0.005 | 0.05 | 0.019 | 12 | 44 | 0.01 |
| Conventional Steel 1 | 0.05 | 0.13 | 1.31 | 0.002 | 0.006 | 0.0014 | 0.009 | 1.6 | 22 | — |
| Conventional Steel 2 | 0.05 | 0.11 | 1.34 | 0.002 | 0.003 | 0.0036 | 0.012 | 0.5 | 48 | — |
| Conventional Steel 3 | 0.13 | 0.24 | 1.44 | 0.012 | 0.003 | 0.0044 | 0.010 | 1.2 | 127 | — |
| Conventional Steel 4 | 0.06 | 0.18 | 1.35 | 0.008 | 0.002 | 0.0027 | 0.013 | 8 | 32 | — |
| Conventional Steel 5 | 0.06 | 0.18 | 0.88 | 0.006 | 0.002 | 0.0021 | 0.013 | 5 | 20 | — |
| Conventional Steel 6 | 0.13 | 0.27 | 0.98 | 0.005 | 0.001 | 0.001 | 0.009 | 11 | 28 | — |
| Conventional Steel 7 | 0.13 | 0.24 | 1.44 | 0.004 | 0.002 | 0.02 | 0.008 | 8 | 79 | — |
| Conventional Steel 8 | 0.07 | 0.14 | 1.52 | 0.004 | 0.002 | 0.002 | 0.007 | 4 | 57 | — |
| Conventional Steel 9 | 0.06 | 0.25 | 1.31 | 0.008 | 0.002 | 0.019 | 0.007 | 10 | 91 | — |
| Conventional Steel 10 | 0.09 | 0.26 | 0.86 | 0.009 | 0.003 | 0.046 | 0.008 | 15 | 142 | — |
| Conventional Steel 11 | 0.14 | 0.44 | 1.35 | 0.012 | 0.012 | 0.030 | 0.049 | 7 | 89 | — |

| | Chemical Composition (wt %) | | | | | | | | |
|---|---|---|---|---|---|---|---|---|---|
| | Cu | Ni | Cr | Mo | Nb | V | Ca | REM | O (ppm) |
| Present Steel 1 | — | — | — | — | — | 0.01 | — | — | 12 |
| Present Steel 2 | — | 0.2 | — | — | — | 0.01 | — | — | 11 |
| Present Steel 3 | 0.1 | — | — | — | — | 0.02 | — | — | 10 |
| Present Steel 4 | — | — | — | — | — | 0.05 | — | — | 9 |
| Present Steel 5 | 0.1 | — | 0.1 | — | — | 0.05 | — | — | 11 |
| Present Steel 6 | — | — | — | 0.1 | — | 0.08 | — | — | 12 |
| Present Steel 7 | 0.1 | — | — | — | — | 0.02 | — | — | 8 |
| Present Steel 8 | — | — | — | — | 0.015 | 0.01 | — | — | 11 |
| Present Steel 9 | — | — | 0.1 | — | — | 0.02 | 0.001 | — | 10 |
| Present Steel 10 | — | 0.3 | — | — | 0.01 | 0.02 | — | 0.01 | 13 |
| Present Steel 11 | — | 0.1 | — | — | — | — | — | — | 12 |
| Conventional Steel 1 | — | — | — | — | — | — | — | — | 22 |
| Conventional Steel 2 | — | — | — | — | — | — | — | — | 32 |
| Conventional Steel 3 | 0.3 | — | — | — | 0.05 | — | — | — | 138 |
| Conventional Steel 4 | — | — | 0.14 | 0.15 | — | 0.028 | — | — | 25 |
| Conventional Steel 5 | 0.75 | 0.58 | 0.24 | 0.14 | 0.015 | 0.037 | — | — | 27 |
| Conventional Steel 6 | 0.35 | 1.15 | 0.53 | 0.49 | 0.001 | 0.045 | — | — | 25 |
| Conventional Steel 7 | 0.3 | — | — | — | 0.036 | — | — | — | — |
| Conventional Steel 8 | 0.32 | 0.35 | — | — | 0.013 | — | — | — | — |
| Conventional Steel 9 | — | — | 0.21 | 0.19 | 0.025 | 0.035 | — | — | — |
| Conventional Steel 10 | — | 1.09 | 0.51 | 0.36 | 0.021 | 0.021 | — | — | — |
| Conventional Steel 11 | — | — | — | — | — | 0.069 | — | — | — |

The conventional steels 1, 2 and 3 are the inventive steels 5, 32, and 55 of Japanese Patent Laid-open Publication No. Hei. 9-194990.
The conventional steels 4, 5, and 6 are the inventive steels 14, 24, and 28 of Japanese Patent Laid-open Publication No. Hei. 10-298708.
The conventional steels 7, 8, 9, and 10 are the inventive steels 48, 58, 60, and 61 of Japanese Patent Laid-open Publication No. Hei. 8-60292.
The conventional steel 11 is the inventive steel F of Japanese Patent Laid-open Publication No. Hei. 11-140582.

TABLE 13

| Steel Product | Sample | Primary Deoxidation Order | Dissolved Oxygen Amount after Addition of Al in Secondary Deoxidation (ppm) | Amount of Ti Added after Deoxidation (%) | Maintenance Time of Molten Steel after Degassing (min) | Casting Speed (m/min) |
|---|---|---|---|---|---|---|
| Present Steel 1 | Present Sample 1 | Mn→ Si | 24 | 0.016 | 24 | 0.9 |
| | Present Sample 2 | Mn→ Si | 25 | 0.016 | 25 | 1.0 |
| | Present Sample 3 | Mn→ Si | 28 | 0.016 | 23 | 1.2 |

TABLE 13-continued

| Steel Product | Sample | Primary Deoxidation Order | Dissolved Oxygen Amount after Addition of Al in Secondary Deoxidation (ppm) | Amount of Ti Added after Deoxidation (%) | Maintenance Time of Molten Steel after Degassing (min) | Casting Speed (m/min) |
|---|---|---|---|---|---|---|
| Present Steel 2 | Present Sample 4 | Mn→ Si | 27 | 0.05 | 23 | 1.1 |
| Present Steel 3 | Present Sample 5 | Mn→ Si | 25 | 0.015 | 22 | 1.0 |
| Present Steel 4 | Present Sample 6 | Mn→ Si | 26 | 0.032 | 25 | 1.1 |
| Present Steel 5 | Present Sample 7 | Mn→ Si | 24 | 0.053 | 26 | 1.2 |
| Present Steel 6 | Present Sample 8 | Mn→ Si | 23 | 0.02 | 31 | 0.9 |
| Present Steel 7 | Present Sample 9 | Mn→ Si | 25 | 0.017 | 32 | 0.95 |
| Present Steel 8 | Present Sample 10 | Mn→ Si | 25 | 0.019 | 35 | 1.05 |
| Present Steel 9 | Present Sample 11 | Mn→ Si | 26 | 0.021 | 28 | 1.1 |
| Present Steel 10 | Present Sample 12 | Mn→ Si | 25 | 0.026 | 26 | 1.06 |
| Present Steel 11 | Present Sample 13 | Mn→ Si | 26 | 0.016 | 24 | 1.05 |

TABLE 14

| Steel Product | Sample | Heating Temp. (° C.) | Flow Rate of Nitrogen into Heating Furnace (l/min) | Heating Time (min) | Rolling Start Temp. (° C.) | Rolling End Temp. (° C.) | Cooling Rate (° C./min) | Nitrogen Content of Matrix (ppm) |
|---|---|---|---|---|---|---|---|---|
| PS 1 | PE 1 | 1,200 | 600 | 130 | 1,010 | 830 | 5 | 120 |
| PS 2 | PE 2 | 1,200 | 310 | 160 | 1,020 | 850 | 6 | 90 |
| | PE 3 | 1,200 | 600 | 120 | 1,020 | 850 | 5 | 120 |
| | PE 4 | 1,200 | 780 | 110 | 1,020 | 850 | 5 | 125 |
| | CE 1 | 1,100 | 200 | 110 | 1,020 | 850 | 5 | 60 |
| | CE 2 | 1,200 | 950 | 110 | 1,020 | 850 | 5 | 350 |
| PS 3 | PE 5 | 1,190 | 720 | 125 | 1,020 | 840 | 6 | 110 |
| PS 4 | PE 6 | 1,230 | 780 | 120 | 1,040 | 840 | 6 | 270 |
| PS 5 | PE 7 | 1,130 | 650 | 160 | 1,030 | 860 | 4 | 110 |
| PS 6 | PE 8 | 1,210 | 660 | 120 | 1,010 | 850 | 5 | 105 |
| PS 7 | PE 9 | 1,240 | 780 | 100 | 1,020 | 830 | 6 | 300 |
| PS 8 | PE 10 | 1,190 | 640 | 120 | 1,000 | 820 | 5 | 95 |
| PS 9 | PE 11 | 1,200 | 650 | 110 | 1,010 | 880 | 4 | 100 |
| PS 10 | PE 12 | 1,180 | 630 | 140 | 1,020 | 860 | 6 | 120 |
| PS 11 | PE 13 | 1,120 | 660 | 160 | 1,030 | 820 | 5 | 90 |
| PS 12 | PE 14 | 1,250 | 380 | 170 | 1,000 | 840 | 4 | 130 |
| PS 13 | PE 15 | 1,225 | 580 | 150 | 1,020 | 860 | 6 | 120 |
| CS 11 | CE 11 | 1,200 | — | — | $Ar_3$ or more | 960 | Naturally Cooled | |

* The conventional steels 1 to 11 are hot-rolled plates manufactured by hot-rolling steel slabs of Table 1 without any nitrogenizing treatment. There is no detailed heating, hot rolling, and cooling condition for the conventional steels 1 to 11.
* The cooling of each present sample is carried out under the condition in which its cooling rate is controlled, until the temperature of the sample reaches 500° C. lower than a ferrite transformation finish temperature. Following this temperature, the present sample is cooled in air.
* The hot-rolling process is carried out under the condition in which the rolling reduction rate in the recrystallization zone is 45 to 50%.
PS : Present Sample;
PE: Present Example;
CS : Conventional Steel; and
CE: Conventional Example

TABLE 15

| Steel Product | Ratios of Alloying Elements after Nitrogenizing Treatment | | | | |
|---|---|---|---|---|---|
| | Ti/N | N/B | Al/N | V/N | (Ti + 2Al + 4B + V)/N |
| Present Example 1 | 1.25 | 13.3 | 4.2 | 0.83 | 10.7 |
| Present Example 2 | 1.67 | 10 | 5.6 | 1.1 | 14.3 |
| Present Example 3 | 1.25 | 13.3 | 4.17 | 0.83 | 10.7 |
| Present Example 4 | 1.2 | 13.9 | 4.0 | 0.8 | 10.3 |
| Comparative Example 1 | 2.5 | 6.7 | 8.3 | 1.7 | 21.4 |

TABLE 15-continued

| Steel Product | Ratios of Alloying Elements after Nitrogenizing Treatment | | | | |
|---|---|---|---|---|---|
| | Ti/N | N/B | Al/N | V/N | (Ti + 2Al + 4B + V)/N |
| Comparative Example 2 | 0.43 | 38.9 | 1.43 | 0.28 | 3.7 |
| Present Example 5 | 1.36 | 12.2 | 4.5 | 0.9 | 11.7 |
| Present Example 6 | 1.67 | 24.5 | 2.96 | 0.37 | 16.25 |
| Present Example 7 | 1.27 | 36.7 | 5.4 | 1.8 | 15.4 |
| Present Example 8 | 2.9 | 21 | 2.8 | 4.8 | 13.5 |

TABLE 15-continued

| Steel Product | Ratios of Alloying Elements after Nitrogenizing Treatment | | | | |
|---|---|---|---|---|---|
| | Ti/N | N/B | Al/N | V/N | (Ti + 2Al + 4B + V)/N |
| Present Example 9 | 1.67 | 20 | 3.0 | 1.67 | 11.3 |
| Present Example 10 | 2.0 | 11.1 | 2.5 | 8.0 | 15.4 |
| Present Example 11 | 1.6 | 12.5 | 4.0 | 2.0 | 11.9 |
| Present Example 12 | 1.5 | 12 | 5.0 | 0.83 | 12.7 |
| Present Example 13 | 2.2 | 18 | 2.77 | 2.22 | 10.22 |
| Present Example 14 | 1.92 | 13 | 3.46 | 1.54 | 10.69 |
| Present Example 15 | 1.25 | 10 | 4.17 | — | 10.0 |
| Conventional Example 1 | 4.1 | 13.8 | 0.64 | — | 5.7 |
| Conventional Example 2 | 2.5 | 96 | 0.75 | — | 4.0 |
| Conventional Example 3 | 0.79 | 105.8 | 0.35 | — | 1.5 |
| Conventional Example 4 | 4.1 | 4 | 0.85 | 8.8 | 15.5 |
| Conventional Example 5 | 6.5 | 4 | 1.1 | 18.5 | 28.1 |
| Conventional Example 6 | 3.2 | 2.6 | 0.36 | 16.1 | 21.6 |
| Conventional Example 7 | 1.0 | 9.9 | 2.53 | — | 6.5 |
| Conventional Example 8 | 1.22 | 14.3 | 0.35 | — | 2.2 |

TABLE 15-continued

| Steel Product | Ratios of Alloying Elements after Nitrogenizing Treatment | | | | |
|---|---|---|---|---|---|
| | Ti/N | N/B | Al/N | V/N | (Ti + 2Al + 4B + V)/N |
| Conventional Example 9 | 0.79 | 9.1 | 2.1 | 3.85 | 9.3 |
| Conventional Example 10 | 0.56 | 9.5 | 3.2 | 1.48 | 8.9 |
| Conventional Example 11 | 5.51 | 12.7 | 3.4 | 7.8 | 20.3 |

No nitrogenizing treatment is performed for the conventional examples 1 to 11.

Test pieces were sampled from thick steel plates manufactured as described above. The sampling was performed at the central portion of each hot-rolled product in a thickness direction. In particular, test pieces for a tensile test were sampled in a rolling direction, whereas test pieces for a Charpy impact test were sampled in a direction perpendicular to the rolling direction.

Using steel test pieces sampled as described above, characteristics of precipitates in each steel product (matrix), and mechanical properties of the steel product were measured. The measured results are described in Table 16. Also, the microstructure and impact toughness of the heat affected zone were measured. The measured results are described in Table 17.

These measurements were carried out in the same manner as that of Example 1.

TABLE 16

| Sample | Thickness (mm) | Mechanical Properties of Matrix | | | | Characteristics of Matrix Structure | | | |
|---|---|---|---|---|---|---|---|---|---|
| | | Yield Strength (MPa) | Tensile Strength (MPa) | Elongation (%) | Impact Toughness at −40° C. (J) | Density of Nitrides ($\times 10^6/mm^2$) | Precipitates of Mean Size (μm) | Precipitates of Spacing (μm) | FGS (μm) |
| Present Example 1 | 25 | 387 | 492 | 41.3 | 372 | 210 | 0.019 | 0.4 | 16 |
| Present Example 2 | 25 | 385 | 490 | 42 | 374 | 195 | 0.018 | 0.36 | 18 |
| Present Example 3 | 25 | 384 | 491 | 41 | 373 | 195 | 0.021 | 0.42 | 16 |
| Present Example 4 | 25 | 382 | 490 | 40.5 | 375 | 210 | 0.020 | 0.38 | 19 |
| Comparative Example 1 | 25 | 387 | 487 | 41.2 | 243 | 18 | 0.21 | 0.74 | 24 |
| Comparative Example 2 | 25 | 395 | 499 | 38.9 | 226 | 12 | 0.35 | 0.84 | 26 |
| Present Example 5 | 30 | 392 | 496 | 39.6 | 365 | 179 | 0.025 | 0.32 | 18 |
| Present Example 6 | 30 | 362 | 475 | 38.8 | 373 | 155 | 0.022 | 0.41 | 18 |
| Present Example 7 | 30 | 398 | 512 | 39.5 | 368 | 320 | 0.024 | 0.25 | 17 |
| Present Example 8 | 30 | 368 | 482 | 38.4 | 362 | 173 | 0.023 | 0.42 | 18 |
| Present Example 9 | 35 | 387 | 497 | 39.6 | 366 | 340 | 0.021 | 0.28 | 16 |
| Present Example 10 | 35 | 379 | 486 | 40.1 | 362 | 278 | 0.024 | 0.32 | 16 |
| Present Example 11 | 35 | 387 | 498 | 39.5 | 378 | 214 | 0.024 | 0.34 | 17 |
| Present Example 12 | 35 | 395 | 506 | 38.0 | 375 | 197 | 0.025 | 0.40 | 18 |
| Present Example 13 | 40 | 387 | 503 | 38.5 | 378 | 216 | 0.020 | 0.32 | 15 |

TABLE 16-continued

| Sample | Thickness (mm) | Mechanical Properties of Matrix: Yield Strength (MPa) | Tensile Strength (MPa) | Elongation (%) | Impact Toughness at −40° C. (J) | Characteristics of Matrix Structure: Density of Nitrides ($\times 10^6/mm^2$) | Precipitates of Mean Size (μm) | Precipitates of Spacing (μm) | FGS (μm) |
|---|---|---|---|---|---|---|---|---|---|
| Present Example 14 | 40 | 364 | 487 | 40.2 | 362 | 254 | 0.021 | 0.34 | 18 |
| Present Example 15 | 25 | 386 | 492 | 39.4 | 374 | 218 | 0.019 | 0.31 | 17 |
| Conventional Example 1 | 35 | 406 | 438 | — | | | | | |
| Conventional Example 2 | 35 | 405 | 441 | — | | | | | |
| Conventional Example 3 | 25 | 681 | 629 | — | | | | | |
| Conventional Example 4 | 40 | 472 | 609 | 32 | | Precipitates of MgO—TiN: $3.03 \times 10^6/mm^2$ | | | |
| Conventional Example 5 | 40 | 494 | 622 | 32 | | Precipitates of MgO—TiN: $4.07 \times 10^6/mm^2$ | | | |
| Conventional Example 6 | 50 | 812 | 912 | 28 | | Precipitates of MgO—TiN: $2.80 \times 10^6/mm^2$ | | | |
| Conventional Example 7 | 25 | 681 | 629 | — | | | | | |
| Conventional Example 8 | 50 | 504 | 601 | — | | | | | |
| Conventional Example 9 | 60 | 526 | 648 | — | | | | | |
| Conventional Example 10 | 60 | 760 | 829 | — | | | | | |
| Conventional Example 11 | 50 | 401 | 514 | 18.3 | | | 0.2 μm or less: $11.1 \times 10^3$ | | |

As described in Table 16, each steel product of the present invention is formed with precipitates (Ti-based nitrides) having a very small grain size while having a considerably increased density, as compared to conventional steel products.

TABLE 17

| Sample | Grain Size of Austenite Depending on Heating: Temperature at Reproducible Welding Site (μm) 1,200° C. | 1,300° C. | 1,400° C. | Impact Toughness at −40° C. in Heat Affected Zone Reproducible at 1,400° C. (J): 60 sec | 180 sec | Transition Temp. (° C.) (180 sec) |
|---|---|---|---|---|---|---|
| Present Example 1 | 21 | 38 | 58 | 372 | 320 | −68 |
| Present Example 2 | 22 | 37 | 55 | 385 | 324 | −72 |
| Present Example 3 | 22 | 37 | 56 | 380 | 354 | −69 |
| Present Example 4 | 23 | 36 | 58 | 365 | 323 | −69 |
| Comparative Example 1 | 39 | 72 | 168 | 156 | 85 | −48 |
| Comparative Example 2 | 42 | 82 | 175 | 128 | 64 | −42 |
| Present Example 5 | 28 | 38 | 61 | 362 | 312 | −68 |
| Present Example 6 | 28 | 38 | 62 | 364 | 315 | −71 |
| Present Example 7 | 26 | 36 | 60 | 358 | 310 | −69 |
| Present Example 8 | 27 | 34 | 58 | 367 | 324 | −68 |
| Present Example 9 | 25 | 39 | 57 | 354 | 330 | −65 |
| Present Example 10 | 29 | 40 | 60 | 368 | 324 | −64 |
| Present Example 11 | 30 | 36 | 58 | 354 | 313 | −67 |
| Present Example 12 | 28 | 38 | 54 | 368 | 310 | −63 |
| Present Example 13 | 25 | 37 | 64 | 365 | 305 | −64 |
| Present Example 14 | 24 | 35 | 58 | 384 | 308 | −67 |
| Present Example 15 | 23 | 34 | 56 | 365 | 312 | −65 |
| Conventional Example 1 | | | | | | |
| Conventional Example 2 | | | | | | |
| Conventional Example 3 | | | | | | |
| Conventional Example 4 | | 230 | | | | 132 (0° C.) |

TABLE 17-continued

| Sample | Grain Size of Austenite Depending on Heating Temperature at Reproducible Welding Site (μm) | | | Impact Toughness at −40° C. in Heat Affected Zone Reproducible at 1,400° C. (J) | | |
|---|---|---|---|---|---|---|
| | 1,200° C. | 1,300° C. | 1,400° C. | 60 sec | 180 sec | Transition Temp. (° C.) (180 sec) |
| Conventional Example 5 | | 180 | | | | 129 (0° C.) |
| Conventional Example 6 | | 250 | | | | 60 (0° C.) |
| Conventional Example 7 | | | | | | |
| Conventional Example 8 | | | | | | |
| Conventional Example 9 | | | | | | −61 |
| Conventional Example 10 | | | | | | −48 |
| Conventional Example 11 | | | | | | −42 |

FGS: Grain Size of Ferrite

Referring to Table 17, it can be seen that the size of austenite grains in the heat affected zone at a maximum heating temperature of 1,400° C. is within a range of about 54 to 64 μm in the case of the present invention, whereas the austenite grains in the conventional products (Conventional Steels 4 to 6) have a grain size of about 180 μM or more. Thus, the steel products of the present invention have a superior effect of suppressing the growth of austenite grains at the heat affected zone.

Under a high heat input welding cycle in which the time taken for cooling from 800° C. to 500° C. is 180 seconds, the products of the present invention exhibit a superior toughness value of about 300 J or more as a heat affected zone impact toughness at −40° C. while exhibiting about −60° C. as a transition temperature. That is, the products of the present invention exhibit a superior heat affected zone impact toughness.

Under the same high heat input welding condition, the conventional steel products exhibit a very low toughness value of about 60 to 132 J as a heat affected zone impact toughness at 0° C. Thus, the steel products of the present invention have a considerable improvement in the impact toughness of the heat affected zone, and a considerable improvement in transition temperature, as compared to conventional steel products.

What is claimed is:

1. A method for manufacturing a welding structural steel product, comprising the steps of:

preparing a steel slab containing, in terms of percent by weight, 0.03 to 0.17% C, 0.01 to 0.5% Si, 0.4 to 2.0% Mn, 0.005 to 0.2% Ti, 0.0005 to 0.1% Al, 0.008 to 0.030% N, 0.0003 to 0.01% B, 0.001 to 0.2% W, at most 0.03% P, at most 0.03% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, and $6.5 \leqq (Ti+2Al+4B)/N \leqq 14$;

heating the steel slab at a temperature ranging from 1,100° C. to 1,250° C. for 60 to 180 minutes;

hot rolling the heated steel slab in an austenite recrystallization range at a rolling reduction rate of 40% or more; and cooling the hot-rolled steel slab at a rate of 1° C./min or more to a temperature corresponding to ±10° C. from a ferrite transformation finish temperature.

2. The method according to claim 1, wherein the slab further contains 0.01 to 0.2% V while satisfying conditions of $0.3 \leqq V/N \leqq 9$, and $7 \leqq (Ti+2Al+4B)/N \leqq 17$.

3. The method according to claim 1, wherein the slab further contains one or more selected from a group consisting of Ni: 0.1 to 3.0%, Cu: 0.1 to 1.5%, Nb: 0.01 to 0.1%, Mo: 0.05 to 1.0%, and Cr: 0.05 to 1.0%.

4. The method according to claim 1, wherein the slab further contains one or both of Ca: 0.0005 to 0.005% and REM: 0.005 to 0.05%.

5. The method according to claim 1, wherein the slab preparation step comprises:

adding a deoxidizing element having a deoxidizing effect higher than that of Ti to molten steel so as to control a dissolved oxygen amount of 30 ppm or less, adding Ti to the molten steel within 10 minutes so as to control the Ti content of 0.005 to 0.2%, and casting the resultant slab.

6. The method according to claim 5, wherein the deoxidation is carried out in the order of Mn, Si, and Al.

7. The method according to claim 5, wherein the molten steel is cast at a speed of 0.9 to 1.1 m/min in accordance with a continuous casting process while being weak cooled at a secondary cooling zone with a water spray amount of 0.3 to 0.35 l/kg.

8. A method for manufacturing a welding structural steel product, comprising the steps of:

preparing a steel slab containing, in terms of percent by weight, 0.03 to 0.17% C, 0.01 to 0.5% Si, 0.4 to 2.0% Mn, 0.005 to 0.2% Ti, 0.0005 to 0.1% Al, at most 0.005% N, 0.0003 to 0.01% B, 0.001 to 0.2% W, at most 0.03% P, at most 0.03% S, at most 0.005% O, and balance Fe and incidental impurities;

heating the steel slab at a temperature ranging from 1,100° C. to 1,250° C. for 60 to 180 minutes while nitrogenizing the steel slab to control the N content of the steel slab to be 0.008 to 0.03%, and to satisfy conditions of $1.2 \leqq Ti/N \leqq 2.5$, $10 \leqq N/B \leqq 40$, $2.5 \leqq Al/N \leqq 7$, and $6.5 \leqq (Ti+2Al+4B)/N \leqq 14$;

hot rolling the nitrogenized steel slab in an austenite recrystallization range at a rolling reduction rate of 40% or more; and cooling the hot-rolled steel slab at a rate of 1° C./min or more to a temperature corresponding to ±10° C. from a ferrite transformation finish temperature.

9. The method according to claim 8, wherein the slab further contains 0.01 to 0.2% V while satisfying conditions of $0.3 \leqq V/N \leqq 9$, and $7 \leqq (Ti+2Al+4B)/N \leqq 17$.

10. The method according to claim 8, wherein the slab further contains one or more selected from a group consisting of Ni: 0.1 to 3.0%, Cu: 0.1 to 1.5%, Nb: 0.01 to 0.1%, Mo: 0.05 to 1.0%, and Cr: 0.05 to 1.0%.

11. The method according to claim 8, wherein the slab further contains one or both of Ca: 0.0005 to 0.005% and REM: 0.005 to 0.05%.

12. The method according to claim 8, wherein the slab preparation step comprises:

adding a deoxidizing element having a deoxidizing effect higher than that of Ti to molten steel so as to control a dissolved oxygen amount of 30 ppm or less, adding Ti to the molten steel within 10 minutes so as to control the Ti content of 0.005 to 0.2%, and casting the resultant slab.

13. The method according to claim 12, wherein the deoxidation is carried out in the order of Mn, Si, and Al.

* * * * *